US007234405B2

(12) United States Patent
Hodgson

(10) Patent No.: US 7,234,405 B2
(45) Date of Patent: Jun. 26, 2007

(54) SEA RESCUE CRAFT

(76) Inventor: Frank Hodgson, 2 Hayfields Rd., Portola Valley, CA (US) 94028

( * ) Notice: Subject to any disclaimer, the term of this patent is extended or adjusted under 35 U.S.C. 154(b) by 0 days.

(21) Appl. No.: 11/225,514

(22) Filed: Sep. 14, 2005

(65) Prior Publication Data

US 2007/0056496 A1 Mar. 15, 2007

(51) Int. Cl.
*B63B 1/00* (2006.01)

(52) U.S. Cl. ..... 114/61.15; 114/61.16

(58) Field of Classification Search ..... 114/61.1, 114/61.14, 61.15, 61.16, 61.17, 61.18, 61.19
See application file for complete search history.

(56) References Cited

U.S. PATENT DOCUMENTS 2,347,959 A * 5/1944 Moore et al. ..... 114/283
4,534,738 A 8/1985 McKnight ..... 440/61 R
4,718,368 A * 1/1988 Ings ..... 114/61.16
5,980,159 A 11/1999 Kazim ..... 405/200
6,003,458 A * 12/1999 Valliere ..... 114/61.18
6,874,439 B2 * 4/2005 Conti ..... 114/61.1

* cited by examiner

*Primary Examiner*—Stephen Avila

(57) ABSTRACT

An apparatus, method and system for rescuing persons and distressed vessels, up to about 50 tons displacement, in foul weather and for transporting loaded full sized truck/ship containers or other loads by water. Two pairs of long straight pontoons, each having five articulated short pontoon segments, support an upper framework formed by six articulatable legs, three on either side. The legs allow the height and span of the craft to be varied. They are connected to and support a central control pod. The control pod contains winches for the support of a vessel or of other loads under the control pod using two slings. A compartment under the control pod can be created by lowering a bottom platform with cables which support the sides of the platform.

23 Claims, 23 Drawing Sheets

4, 41
88
62
64
121
33
97
37
36
28
38
33

97
125
124
36
33
37
4, 41
88
62
64
121
29
29, 126
38
63
33
28

97
4, 41
88
62
64
121
29
29, 126
38
63
36
33
37
28
33

SEA RESCUE CRAFT

FIELD OF INVENTION

The present invention relates generally to the design of marine vessels.

USE OF FEDERAL FUNDS

No federal funding, direct or indirect, has been utilized in conjunction with the development of the present invention.

PUBLICATION

The invention disclosed in this application may be the subject of an application filed in another country or under a multilateral agreement that requires publication at eighteen months after filing. Pursuant to 35 U.S.C. 122(b), this application may be published other than in the United States.

PRIOR ART

No prior art can be found which discloses the present invention. There are numerous vessels which are dedicated to the rescue of persons and of vessels in distress. None however relate to or teach the present invention.

U.S. Pat. No. 5,980,159 (Jenan Kazim; 1999) discloses a pontoon type structure with variable volume for stabilizing a vessel and is not directly applicable to the present invention.

U.S. Pat. No. 4,534,738 (Thomas J. McKnight; 1985) discloses a tug type craft with additional propulsion units which can be added to provide extra drive units. It is not directly related to the present invention.

One U.S. Pat. No. 6,874,439 (2005) by Ugo Conti provides considerable insight into the design and functioning of pontoon supported vessels and therefore it is entirely incorporated herein by reference. The Conti patent and craft represent the current state of the art for these types of vessels. The Conti patent refines the use of a pair of long flexing parallel pontoons by disclosing the use of a hinged section at the rear of each pontoon for the support of a propulsion unit in each section. This approach solves a problem unique to vessels which utilize long flexing pontoons which have had the problem of the elevation of the craft's propellers clear of the water when crossing a steep wave. This result is not relevant to the present invention which utilizes 20 hinged and pivoted pontoon segments which are grouped into four long articulating pontoons with two long pontoons on each side of an elevated control pod. Unlike the present invention, the Conti patent does not utilize articulating pontoon segments which can roll and pitch freely. Further, the Conti vessel lacks an articulatable supporting framework to allow the span or height of the craft to be varied. The Conti patent discloses the use of four legs to support a central load by distributing it over the tops of the two pontoons. The present invention distributes a central load to 6 supporting legs, each resting on one of 6 sets of 3 supporting points within 16 of the 20 pontoon segments. These 16 freely pivoted or hinged points are centrally located below their respective centers of buoyancy in the pontoon segments and provide great stability to the craft.

The present invention is symmetric end-to-end and has two cable supported slings for supporting of a vessel up to about 50 tons. The ability to vary both the height and span of the craft makes it much easier to sling a load. The compartment stored compactly under the control pod can be lowered and used for the transport of a 25 ton load or about 40 people.

The present invention provides a new, flexible and safer method for the rescue of persons and distressed vessels. It is also a useful general transport vessel for transport of large awkward loads by water. The need for a craft of this type has been long standing and the related design problems have been examined by many persons for decades. What has been needed is a craft which has good speed over extended distances, excellent endurance in adverse weather conditions, flexibility in the support and salvage of distress vessels in high seas and the ability to rescue substantial numbers of persons. Until the present invention, no satisfactory method to resolve these problems has been available.

SUMMARY OF THE INVENTION

The present invention is an apparatus, method and system for rescuing persons, up to 40 people, and distressed craft, up to about 50 tons displacement, at sea, day or night, under severe weather conditions. Severe weather conditions is defined as winds averaging over 60 knots and seas running over 40 foot. The present invention is a marine rescue vessel utilizing articulating pontoon segments for flotation. The preferred embodiment of the present invention provides a new, versatile and safer craft for marine use.

It an objective of the present invention to provide an easier and safer means for a crew to rescue distressed vessels and persons at sea in foul weather.

It is another objective to provide a craft having variable height and span for the support of a distressed vessel with one or more slings.

It is a further objective to provide an improved apparatus, method and system for transporting goods and/or persons by water.

The specific major innovations of the present invention are the use of (1) a central elevated control pod supported by a framework which rests on four sets of five linear articulated pontoon segments, (2) a supporting framework comprised of six articulatable legs which can be altered to change the height or width of the craft, (3) the bottom ends of the six supporting legs each of which are pivotally supported on the top of a three-cornered table with each of the three vertical legs of each table being pivotally or rotatably supported below the center of buoyancy of a pontoon segment, (4) pontoon segments which can pitch and/or or roll independently, (4) variable length limit struts which limit excessive upward or downward flexing of ends of the craft, (5) two independently winched cable supported slings for the support of a load, (6) a retractable platform stored under the control pod which can be lowered to create a compartment for transport of cargo or people.

This device, method and system is new, useful and not obvious as the need has been long standing and the required technologies have been available for decades. These and other objects an advantages of the present invention will become clear to those skilled in the art in view of the description of the best presently known mode of carrying out the invention and the applicability of the preferred embodiment as described here in and as illustrated in the several figures of the of the drawings.

SPECIFICATION

Best Method for Carrying out Invention

Figure 1:
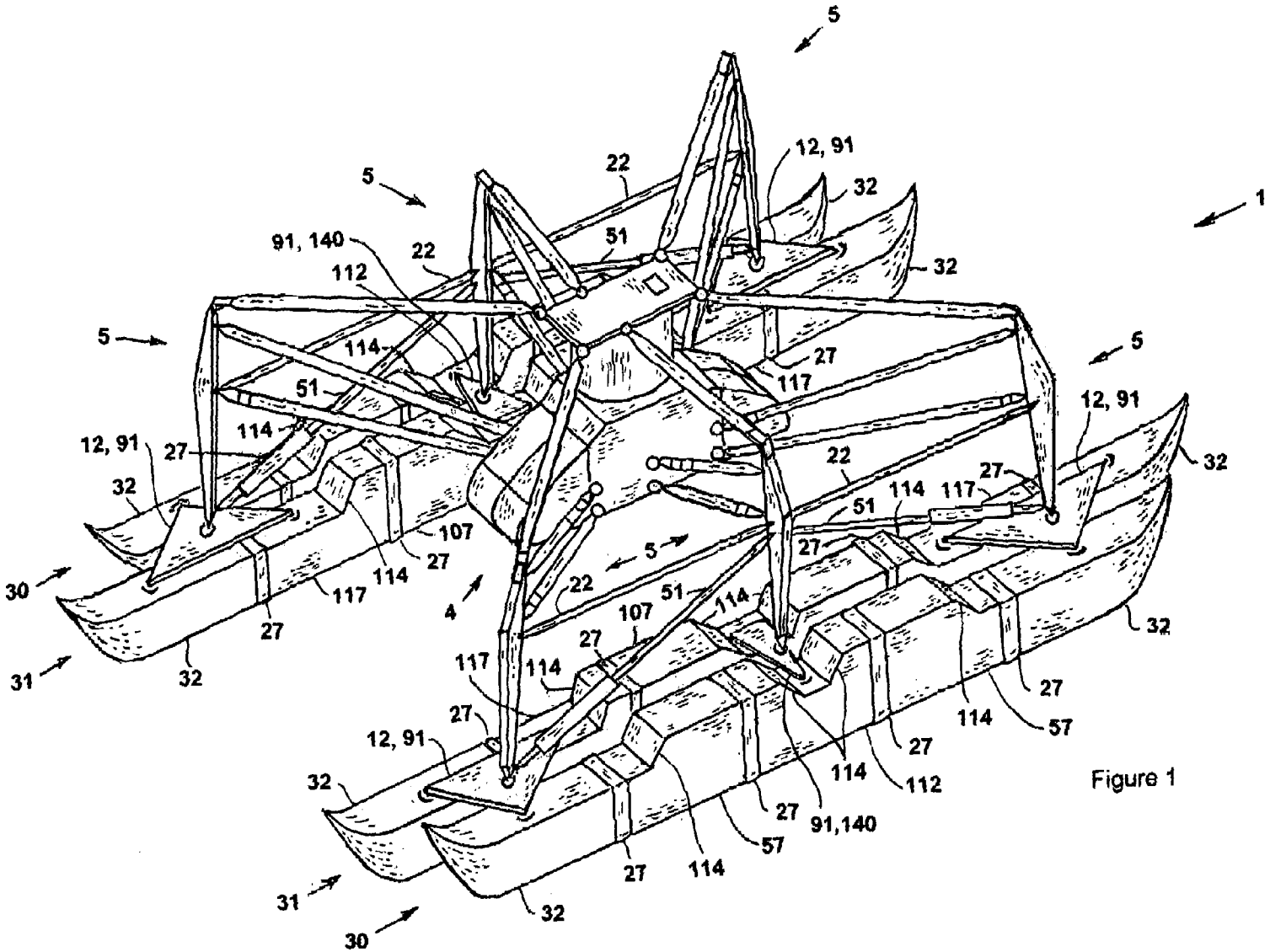
FIG. 1 shows a perspective view of the craft according to the present invention

The preferred embodiment of the present invention is the apparatus, system and method described herein below for the rescue of people (at least 40 persons plus a crew of 4 or 5) and/or a medium sized craft, up to about 50 tons displacement, at sea, day or night, under severe weather conditions. Severe weather conditions is defined as winds averaging over 60 knots and seas running over 40 feet. The present invention, a marine vessel, also has considerable utility as a water transport means for awkward loads up to about 50 tons in adverse weather conditions. In less severe weather larger loads can be safely transported.

General Description

Four long pontoons, each roughly square in cross section (4.5 feet wide and 4.5 or 6.5 feet high), two on each side, support an articulatable upper framework. The framework has six supporting legs, three on each side, supporting a central elevated control pod. Each of the four long pontoons is comprised of five pontoon segments. The two center inner pontoon segments, one on each side, are 23 feet long. The eight end pontoon segments have slightly upturned prows and each is 16 feet long. Each of the other ten pontoon segments is 11 feet long. Adjacent pontoon segments pitch independently relative to each other about a low connecting horizontally hinged joint. The end pontoon segments and the pontoon segments in the two outer long pontoons also roll independently.

The bottoms of the six supporting legs of the framework are each respectively pivotally and centrally attached to and supported by one of six rigid triangular three-legged tables, three on each side. The three table legs of each table are each supported from below the center of buoyancy of a supporting pontoon segment. Each middle inner pontoon segment supports two inboard legs of a smaller center table with hinged supports and an adjacent outboard middle pontoon segment pivotally supports the third leg. Two of the three legs of each of the four outer end tables are each pivotally supported by one of two end pontoon segments and the third leg is pivotally supported by an inboard inner pontoon segment. Four pontoon segments, two in each outer long pontoon, act as spacing elements and indirectly provide support for the craft. The words 'table top' are defined to be a frame or plate.

The span and height of the craft are varied by adjusting the shape of all of the six supporting legs by changing the lengths of two of the four struts which form each of them with hydraulic means. Winches are affixed to the inside of the control pod on the bottom. They allow two cable supported slings to lift and support a load under the control pod. The craft can sling and transport a loaded full sized ship/truck container.

The craft can be structured to turn on its own axis (zero turning radius) and when engaged in harbor activities or in on-site rescue operations, it can have good mobility in any direction. It has a top speed of 45 knots in moderate weather and sea conditions, with a range of 2000 nautical miles. It is 82 feet long and the beam can be varied from 30 to 82 feet (an open span of 8 to 60 feet). The maximum working clearance under the craft is about 30 feet but is dependent on the weight and shape of the load. The displacement of the craft is about 200 tons with a dead weight of about 18 tons. Fully fueled (15 tons) with no load, the craft has a draft of about 9 inches. The effective footprint of the craft is about 1440 square feet. The joints between pontoon segments are sleeved to exclude water and to reduce drag. The bottom and sides of the pontoon segments are coated with teflon to further reduce drag.

The articulating design of the pontoon segments allows them to efficiently follow the contours of the waves. The craft is symmetric end-to-end for stability in handing slung loads. The modular construction of the craft allows it to be disassembled and then transported by truck, aircraft and/or ship to another location for reassembly.

The control pod is 24 feet long, 6.5 feet wide and 8 feet high. The top is extended upward another 6 feet to a horizontal top rack mounted directly above the control pod. The space between the top of the control pod and the top rack is enclosed. Twenty-four struts, six vertical sets of four, three sets on each side, form the supporting legs and are affixed to and are pivoted from the center of the control pod on each side. For each of the six vertical sets, the six top struts are affixed to and pivoted from the sides of the top rack. The control pod is also stabilized at each of its bottom corners by four outer braces, each of which extends outward and attaches to an outer bottom strut. The control pod has top, bottom and side access hatches. There is a hatch in the top of the top rack. Each end of the control pod is comprised of a clear curved lexan enclosure containing two outward facing seats for the crew and controls for operating the craft. A hoist is attached inside the control pod above the bottom hatch.

An open compartment can be created for housing personnel or cargo by lowering a bottom platform, a flat plate, downward from the bottom of the control pod. It is supported by 14 pairs of cables attached to and extending downward at spaced intervals from each side of the control pod, 7 pairs on each side, to the sides of the bottom platform. The compartment thus created is enclosable at its ends, is 6.5 feet high and has the same footprint as the control pod (24 feet long by 6.5 feet wide). Webbing or canvas encloses the lower sides of the compartment which can house at least 40 persons. Two sets of horizontally articulatable hinged plates are attached to the bottom platform at each end and can enclose the ends or can be let down by ramp cables to create a walkway for level or ramp access to a dock or to a beach. The bottom platform has a bottom hatch congruent with the bottom hatch of the control pod.

Propulsion is with tug type electric powered units, with water jet thrusters and/or with fuel driven engines with propellers. Preferably, four motor-generator sets are housed, one each, in each end of each of the two inner middle pontoon segments.

It is to be understood that achieving the secure support of a distressed vessel of 50 tons displacement in foul weather at sea represents a major challenge and that transport of such a supported load to a safe anchorage in some cases would also require towing of the slung vessel and the supporting craft by a sea going tug. Two of these units should be able to effectively support a distressed 100 ton displacement vessel by providing support at the bow and stem.

The present invention, termed the Sea Dog, provides a new, versatile and safer craft for the rescue of persons and small vessels in distress at sea and for the transport of material and persons in unusual maritime situations. Currently no craft of this type exists.

BACKGROUND OF THE INVENTION

The pontoon craft disclosed by Ugo Conti, U.S. Pat. No. 6,874,439 (2005), provides considerable insight into the problems posed by basic pontoon design constraints. The entire Conti patent therefore is incorporated herein by reference as representative of the state of the art of this type of design. The Conti craft is comprised of two long parallel flexible cylindrical pontoons, each with a separate, horizontally rotatable attached section at the stern which houses a propulsion unit. The front of each pontoon is substantially upturned. A four legged flexible non-articulatable framework is centrally attached, two legs each, to the top of each of the two pontoons. This framework is attached to and centrally supports a small boat which houses the controls for the craft. The Conti craft has a fixed span and height.

DETAILED DESCRIPTION

Referring particularly to the figures wherein like-referenced numbers have been applied to like-parts throughout the description, the sea rescue craft, the Sea Dog, according to the present Invention being designated by the general reference number 1. The preferred embodiment, as set out below, discloses specific dimensions and specifications for a craft of a given size, it being understood that some of the dimensions and specifications for a craft of this type, but of another size, may be different.

General Configuration

Figure 2:
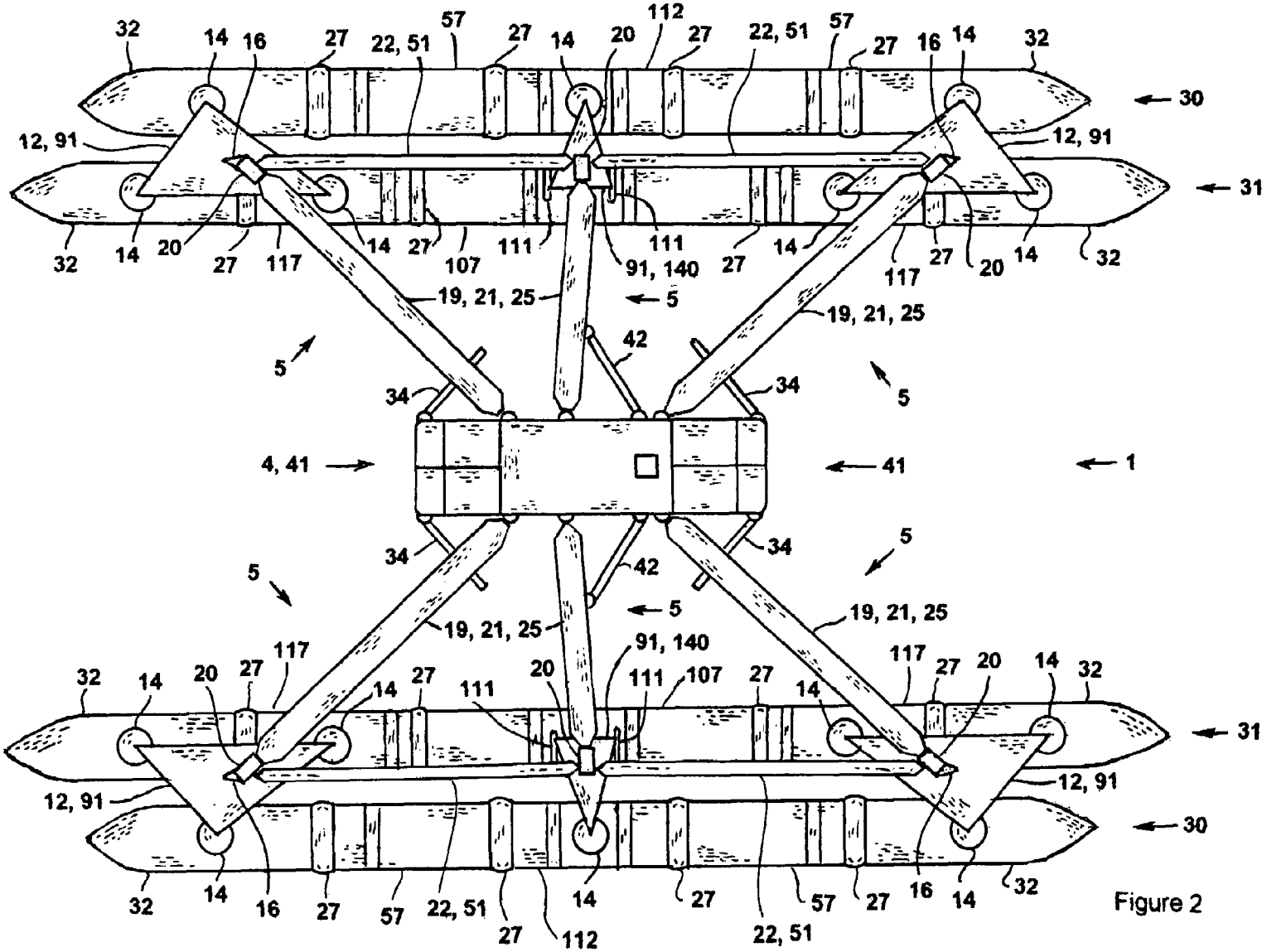
FIG. 2 shows a top view of the craft
Figure 3:
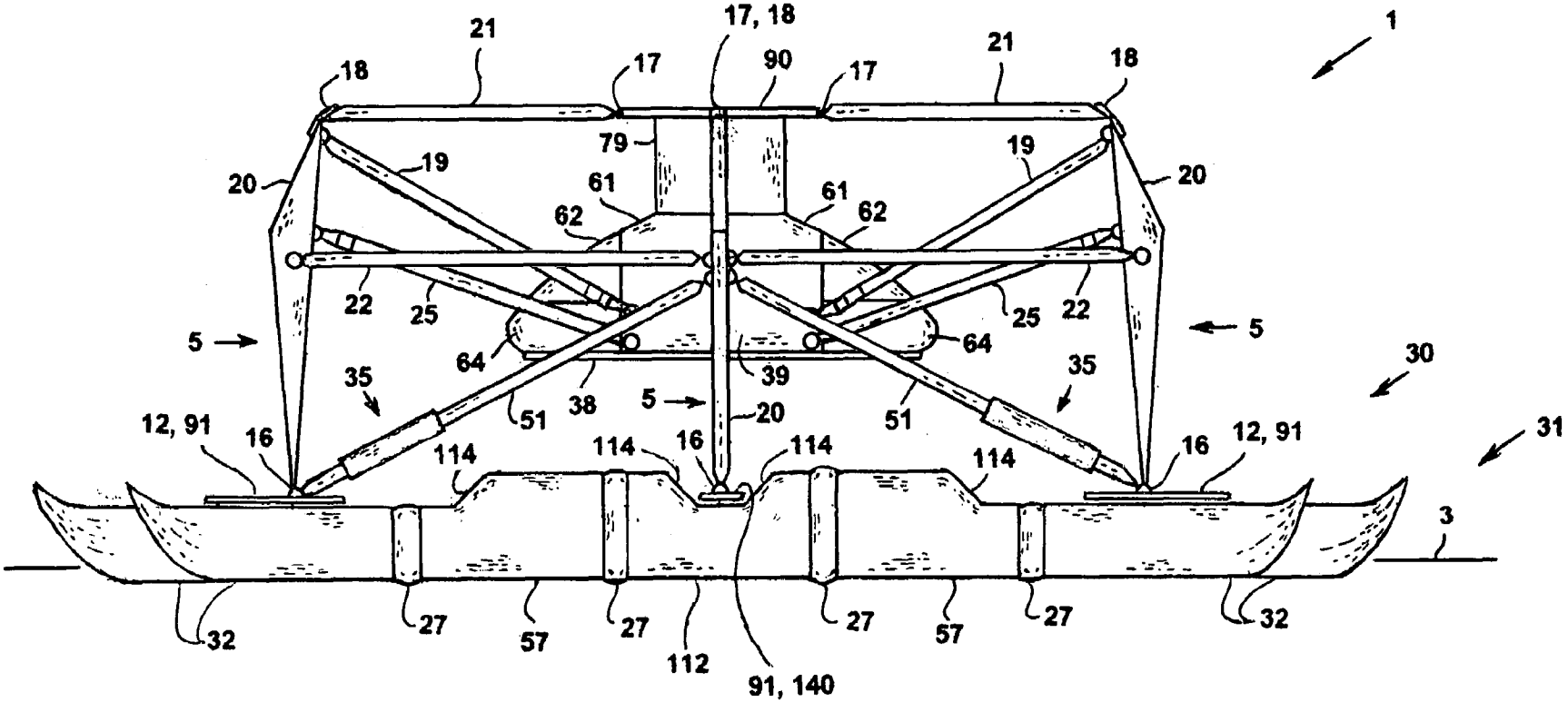
FIG. 3 shows a side view of the craft
Figure 4:
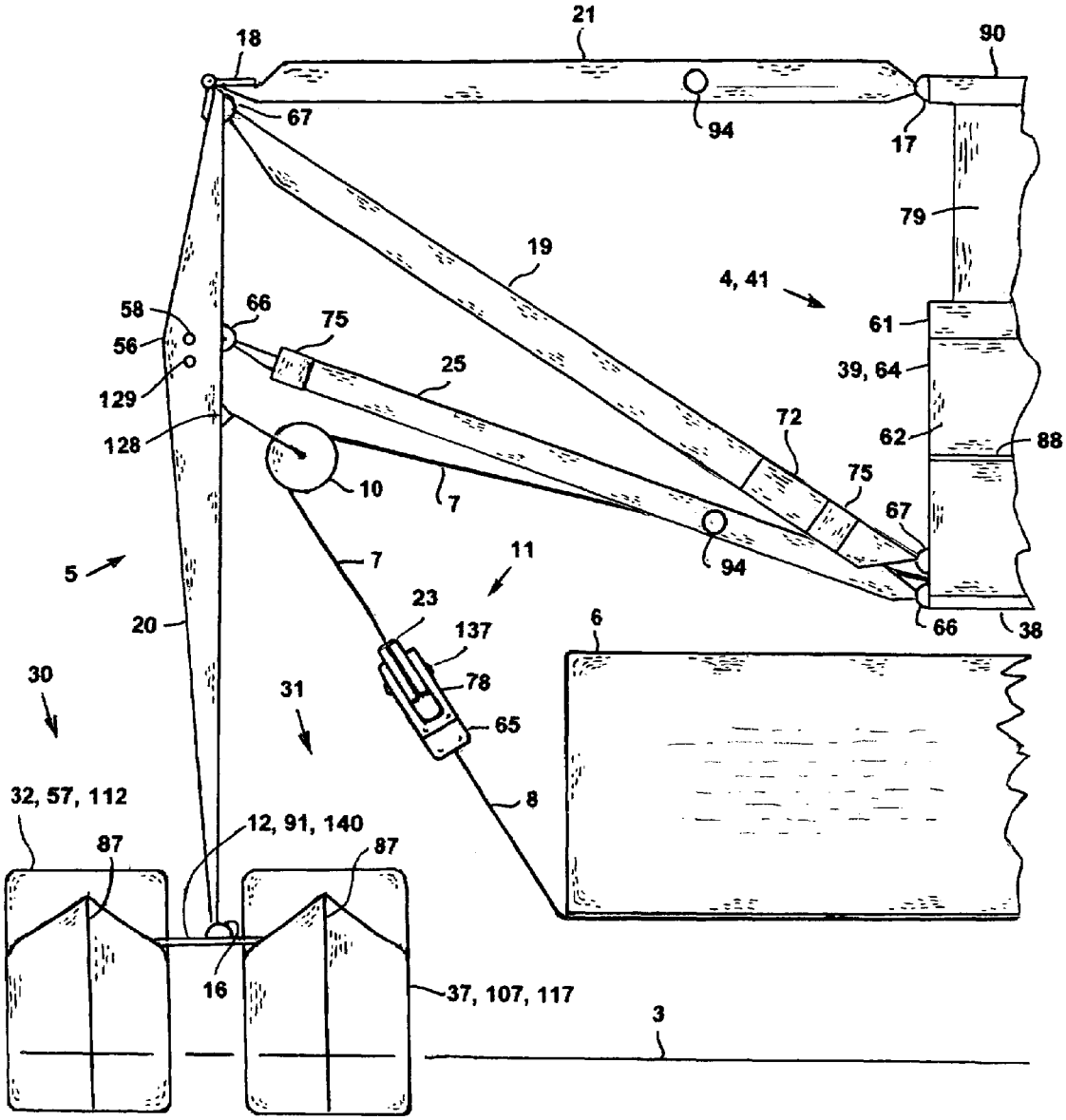
FIG. 4 shows a partial end view of the craft

FIG. 1 shows a perspective view of said craft situated on water 3, said craft 1 comprised a central elevatable control pod, indicated by the general reference number 4, six articulatable legs, each indicated by the general reference number 5, and twenty pontoon segments 32, 57, 107, 112, 117, said twenty pontoon segments 32, 57, 107, 112, 117 comprised of eight end pontoon segments 32, four outboard spacer pontoon segments 57, two inner middle pontoon segments 107, two outer middle pontoon segments 112 and four inboard adjacent pontoon segments 117, said pontoon segments 32, 57, 107, 112, 117 arranged in four rows of five pontoon segments each, said four rows, an inner row and an outer row on each side of said control pod 4, each of said two inner rows indicated by the general reference number 31 and termed an inner long pontoon 31 and each of said two outer rows indicated by the general reference number 30 and termed an outer long pontoon 30, each of said outer long pontoons 30 being parallel to, outboard of, centered on and separated from, by 2 feet, one of said inner long pontoons 31, said five pontoon segments 32, 107, 117 comprising each of said inner long pontoons 31, symmetrically from one end to the other, (1) a first end pontoon segment 32, (2) a first adjacent pontoon segment 117, (3) an inner middle pontoon segment 107, (4) a second adjacent pontoon segment 117 and (5) a second end pontoon segment 32, said five pontoon segments 32, 57, 112 comprising each of said outer long pontoons 30, symmetrically from one end to the other, (1) a first end pontoon segment 32, (2) a first spacer pontoon segment 57, (3) an outer middle pontoon segment 112, (4) a second spacer pontoon segment 57 and (5) a second end pontoon segment 32, as shown in FIG. 2 in a plan view of the craft 1, in FIG. 3 in a side view of the craft 1 and in FIG. 4 in an end view.

A floating object is defined to include, but not limited to, ships, boats, vessels, launches, rafts, barges, sculls, single and multiple hulled craft, inflatables, pontoons, outriggers and buoys and specially includes said pontoons 30, 31. An articulated floating object is defined as at least three aligned floating objects, each pair of which is horizontally hinged together or pivotally and horizontally hinged together.

Rectangular Pontoon Segments; Bottom, Sides, Ends

Referring now to said twelve pontoon segments 57, 107, 112, 117 each being comprised of a flat rectangular bottom surface 83, said bottom surface 83 being 4.5 feet wide and, except for said two inner middle pontoon segments 112 being 11 feet long, said two inner middle pontoon segments each being 23 feet long, two parallel flat long vertical rectangular surfaces, termed side surfaces 84 respectively attached along their bottom edges to the outer edges of said bottom surface 83, two parallel flat vertical surfaces, termed end surfaces 86, respectively attached at their bottom edges, one at each end, to the ends of said bottom surface 83, the outer vertical edges of each of said end surfaces 86 respectively affixed on either side to the vertical ends of said two vertical surfaces 86 as shown in FIGS. 6A-6D, 7A, 7B, the upper portions of said side surfaces 84 and end surfaces 86 of said pontoon segments 57, 107, 112, 117 each further comprised as set out below.

Inner Middle Pontoon Segments

Said two rectangular inner middle pontoon segments 107 each further comprised with the top edges of each of said two ends 86 being horizontal and being 6.5 feet high, the top outer edges of each of said two sides 84 being 6.5 feet high at their outer ends and for a horizontal distance of 7 feet inward from their ends, said four top edges of said sides 84 then respectively angled downward and inward at 45 degrees to a level of 4.5 feet high, the center top edges of said two side surfaces 84 being horizontal, 5 feet long and 4.5 feet high, three flat rectangular horizontal top plates 85, two of said top plates 85 being of equal size and each respectively affixed to the top edge of each of said end surfaces 86, one on each end, and extending inward 7 feet and attached along its outer edges, on either side, to the top outer edges of said sides 84, the third of three of said top plates 85 centrally affixed along its outer edges, on either side, to the top horizontal center edges of said sides 84, sixteen flat rectangular sloping surfaces, each termed a facing plate 114, the ends of each of two of said sixteen facing plates 114 affixed, on each side, to the downward angled edges of said vertical sides 84, the top outer edge of each of said two facing plates 114 respectively affixed to the inner edge of said outer top surface 85 and the bottom inner edge of each of said facing plates 114 respectively affixed to the outer edge of said central third top surface 85 as shown in FIGS. 1, 3, 4.

Outer Middle Pontoon Segments

Said two rectangular outer middle pontoon segments 112 each further comprised with the top edges of each of said ends 86 being horizontal and being 6.5 feet high, the top outer edges of each of said two sides 84 being 6.5 feet high at their outer ends and for a horizontal distance of 2 feet inward from their ends, said four top edges of said sides 84 then respectively angled downward and inward at 45 degrees to a level of 4.5 feet high, the center top edges of said two side surfaces 84 being horizontal, 3 feet long and 4.5 feet high, three flat rectangular horizontal top plates 85, two of said top plates 85 being of equal size and each affixed to the top edge of each of said end surfaces 86, one on each end and extending inward 2 feet and attached along its outer edges, on each side, to the top edges of said sides 84, the third of three of said top plates 85 centrally affixed along its outer edges, on each side, to the top edges of said sides 84, the ends of each of two of said sixteen facing plates 114 affixed, on each side, to the downward angled edges of said vertical sides 84, the top outer edge of each of said two facing plates 114 respectively affixed to the inner edge of said outer top surface 85 and the bottom inner edge of each of said facing plates 114 respectively affixed to the outer edge of said central third top surface 85 as shown in FIGS. 1, 2, 3, 4.

Adjacent Pontoon Segments

Said four rectangular adjacent pontoon segments 117 each further comprised with the top edges of each of said ends 86 being horizontal, the inner one being 6.5 feet high and the outer one being 4.5 feet high, the top inner edges of each of said two sides 84 being 6.5 feet high at their inner ends and for a horizontal distance of 2 feet outward from their ends, said two top inner edges of said sides 84 then respectively angled downward and inward at 45 degrees to a level of 4.5 feet high, the outer top edges of said two side surfaces 84 being 7 feet long, two flat rectangular horizontal top plates 85, a first top plate 85 being 4.5 feet wide and 2 feet long and a second top plate 85 being 4.5 feet wide and 7 feet long, said first top plate 85 affixed along its inner edge to the top edge of the inner end of said end surface 86, and extending outward 2 feet and attached, on each side, to the top inner edges of said sides 84, said second top plate 85 affixed at its outer end to the top edge of said end surface 86 and extending inward 7 feet and attached, on each side, to the top outer edges of said sides 84, the ends of one of said sixteen facing plates 114 affixed, on each side, to the downward angled edges of said vertical sides 84, the top inner edge of said facing plate 114 affixed to the outer edge of said inner top surface 85 and the bottom inner edge of said facing plate 114 affixed to the inner edge of said outer top surface 85 as shown in FIGS. 1, 2, 3, 4.

Spacer Pontoon Segments

Said four rectangular spacer pontoon segments 57 each further comprised with the top edges of each of said ends 86 being horizontal, the inner one being 6.5 feet high and the outer one being 4.5 feet high, the top inner edges of each of said two sides 84 being 6.5 feet high at their inner ends and for a horizontal distance of 7 feet outward from their ends, said two top inner edges of said sides 84 then respectively angled downward and inward at 45 degrees to a level of 4.5 feet high, the outer top edges of said two side surfaces 84 being 2 feet long, two flat rectangular horizontal top plates 85, a first top plate 85 being 4.5 feet wide and 7 feet long and a second top plate 85 being 4.5 feet wide and 2 feet long, said first top plate 85 affixed along its inner edge to the top edge of the inner end of said end surface 86, and extending outward 7 feet and attached, on each side, to the top inner edges of said sides 84, said second top plate 85 affixed at its outer end to the top edge of said end surface 86 and extending inward 2 feet and attached, on each side, to the top outer edges of said sides 84, the ends of one of said sixteen facing plates 114 affixed, on each side, to the downward angled edges of said vertical sides 84, the top inner edge of said facing plate 114 affixed to the outer edge of said inner top surface 85 and the bottom inner edge of said facing plate 114 affixed to the inner edge of said outer top surface 85 as shown in FIGS. 1, 2, 3, 4.

End Pontoon Segments

Referring now to said eight end pontoon segments 32, each comprised of an outwardly and upwardly curved elongated bottom surface 83, said bottom surface 83 being 4.5 feet wide at its inner end, said inner end being perpendicular to the long axis of said end pontoon 32 and extending horizontally with parallel sides outward 11 feet and then narrowing and tapering outward 5 feet and upward 6 feet forming the curved front and bottom of a prow 87, a flat vertical end surface 86 perpendicularly attached at the inner bottom edge of said bottom surface 83, two long vertical surfaces 84 their inner vertical edges 4.5 feet high and respectively attached to the vertical sides of said inner end surface 86, extending outward in respective vertical planes, said vertical planes being parallel to each other, the top and bottom edges of each of said vertical planes being horizontal for 11 feet, and attached to, along their bottom edges, on each side, for 11 feet to the outer edges of said bottom surface 83, said two vertical planes then curved upward and outward and attached smoothly and roundly for 5 feet to the outer surface of said bottom surface 83 forming the sides of said prow 87, a horizontal top surface 85 affixed on its inner edge to the top of said vertical end surface 86 and extending outward, the sides of said top surface 85 being parallel and affixed to the tops of said two side surfaces 84 for 11 feet and then curving upward and outward for 5 feet and being affixed, on each side, to the tops of said two upward curved side surfaces 84 along their outer upward curved ends forming the top of said prow 87 as shown in FIGS. 1, 2, 3, 4.

The exterior edges and corners of all of said pontoon segments 32, 57, 107, 112, 117 being rounded with at least a 2 inch radius.

Pontoon Segment Connections

Figure 7A:
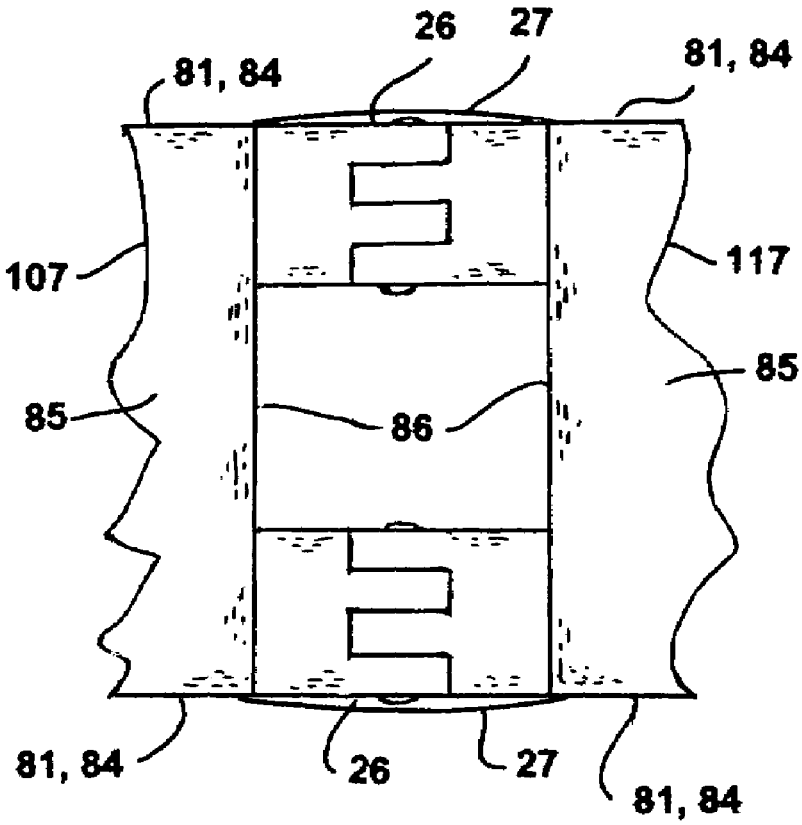
FIGS. 7A and 7B show top and side views of a hinged junction between pontoon segments
Figure 7B:
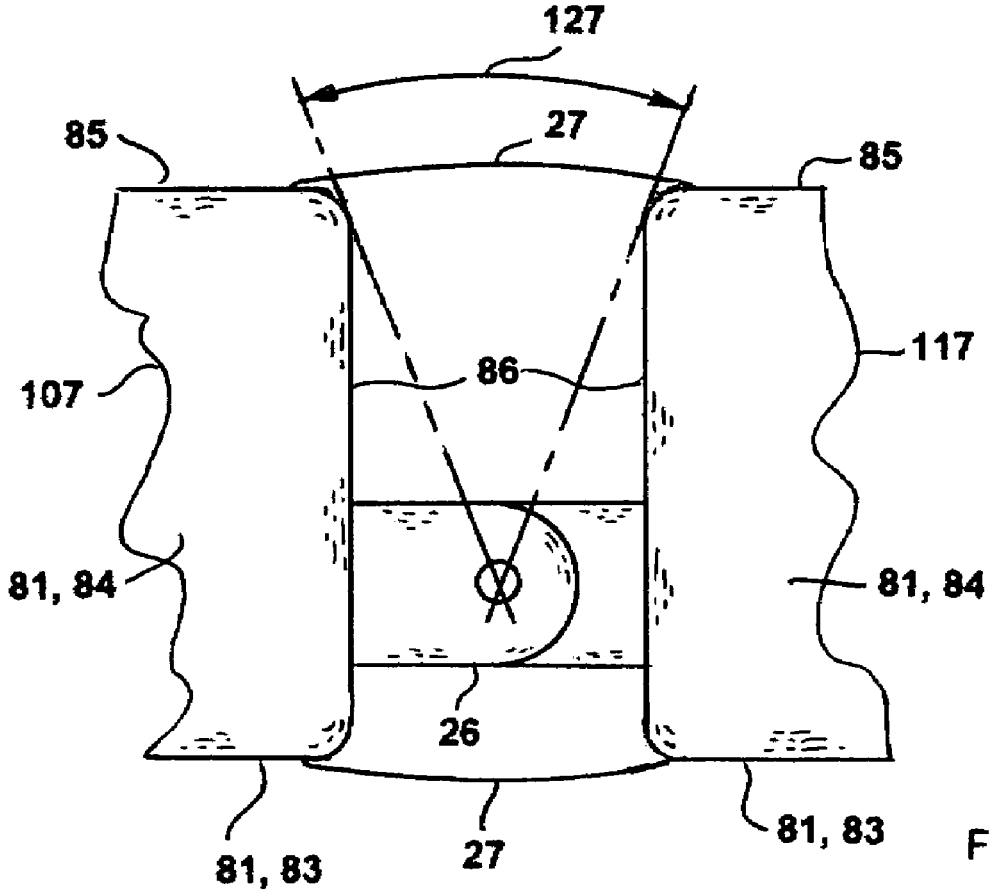

The two inner pairs of pontoon segments 107, 117 of each of said two inner long pontoons 31 are flexibly attached to each other at their ends by hinging means, said hinging means comprised of hinges 26 affixed to flex about a horizontal axis along and 1 foot below the midpoint of the adjacent ends of each pair of said pontoon segments 107, 117, the adjacent ends of said pontoon segments 107, 117 at said hinge 26 being one foot apart, as shown in FIGS. 7A and 7B.

Figure 8A:
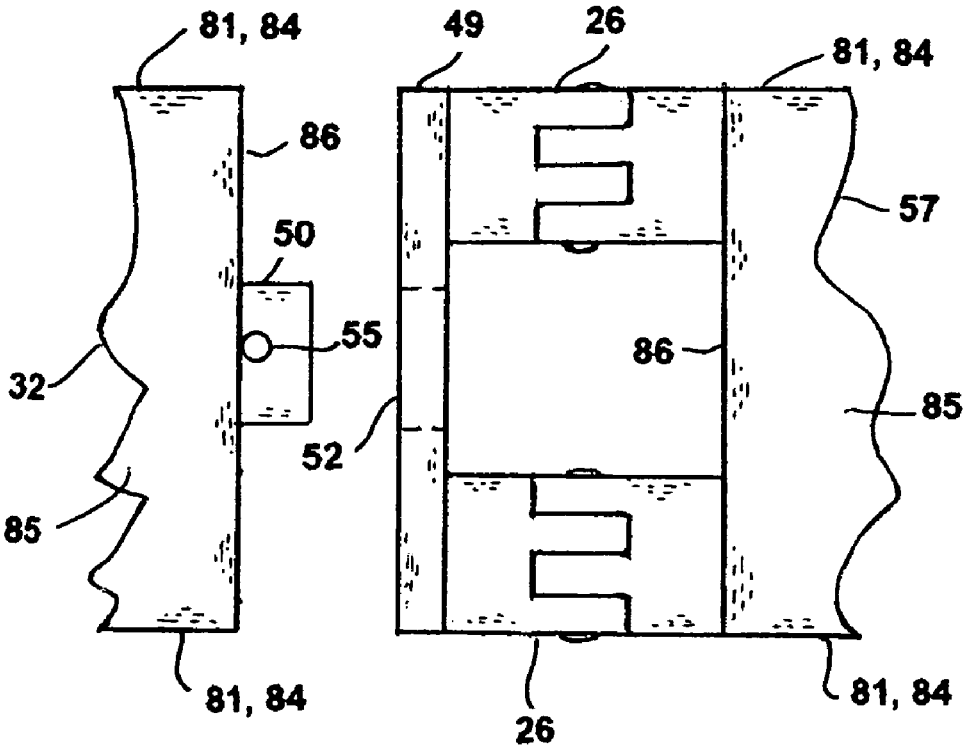
FIG. 8A shows an expanded top view of a hinged junction between pontoon segments
Figure 8B:
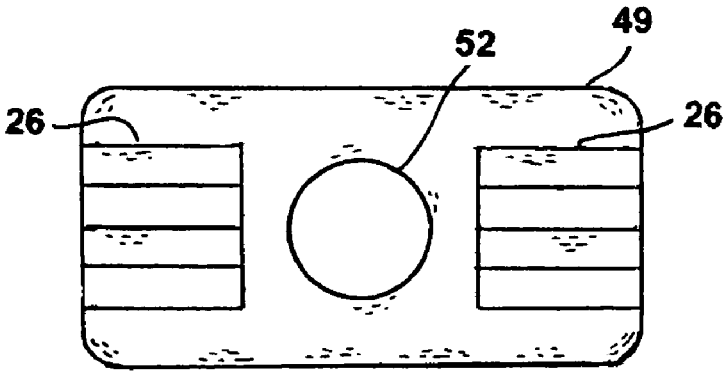
FIG. 8B shows an end view of a bearing plate
Figure 8C:
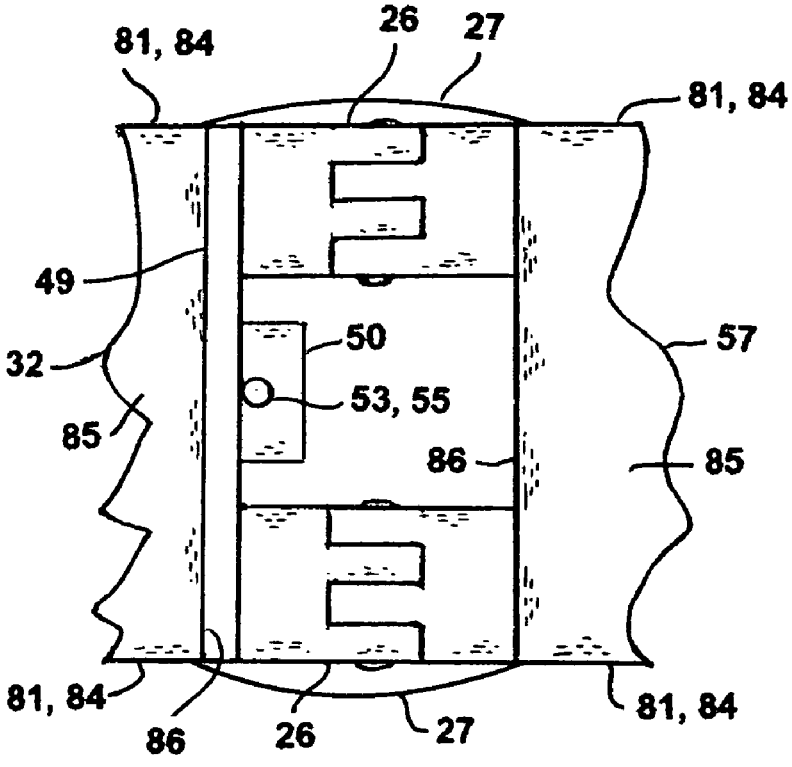
FIGS. 8C, 8D show top and side views of a hinged and pivoted junction between pontoon segments
Figure 8D:
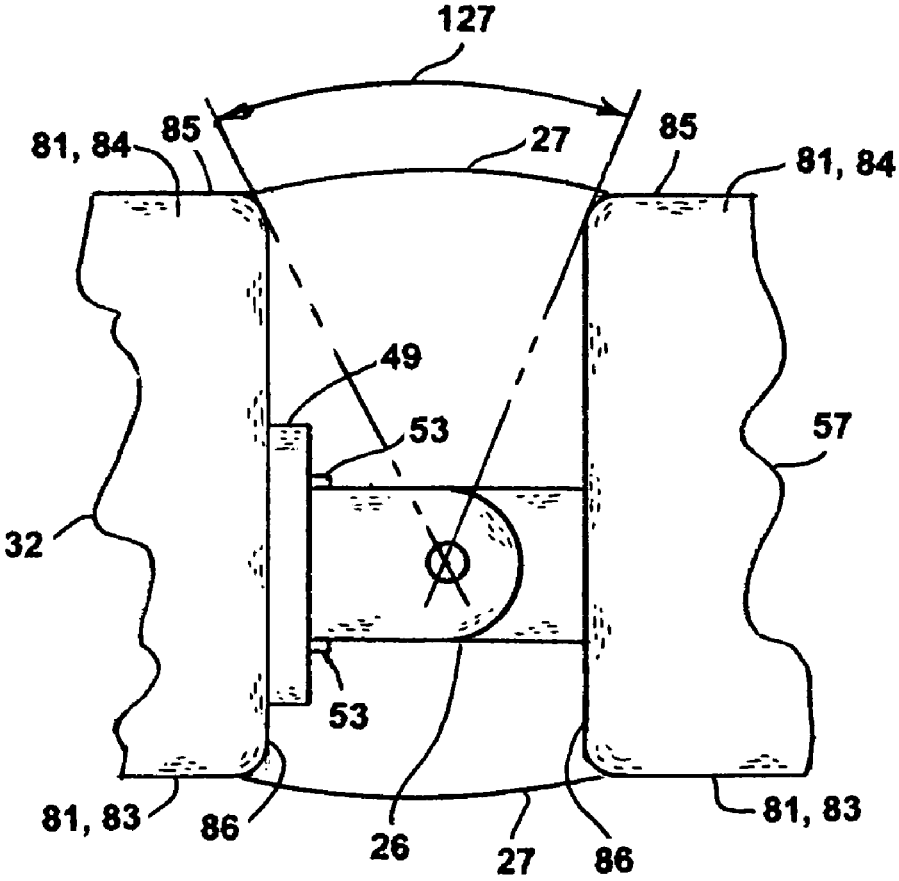
Figure 9:
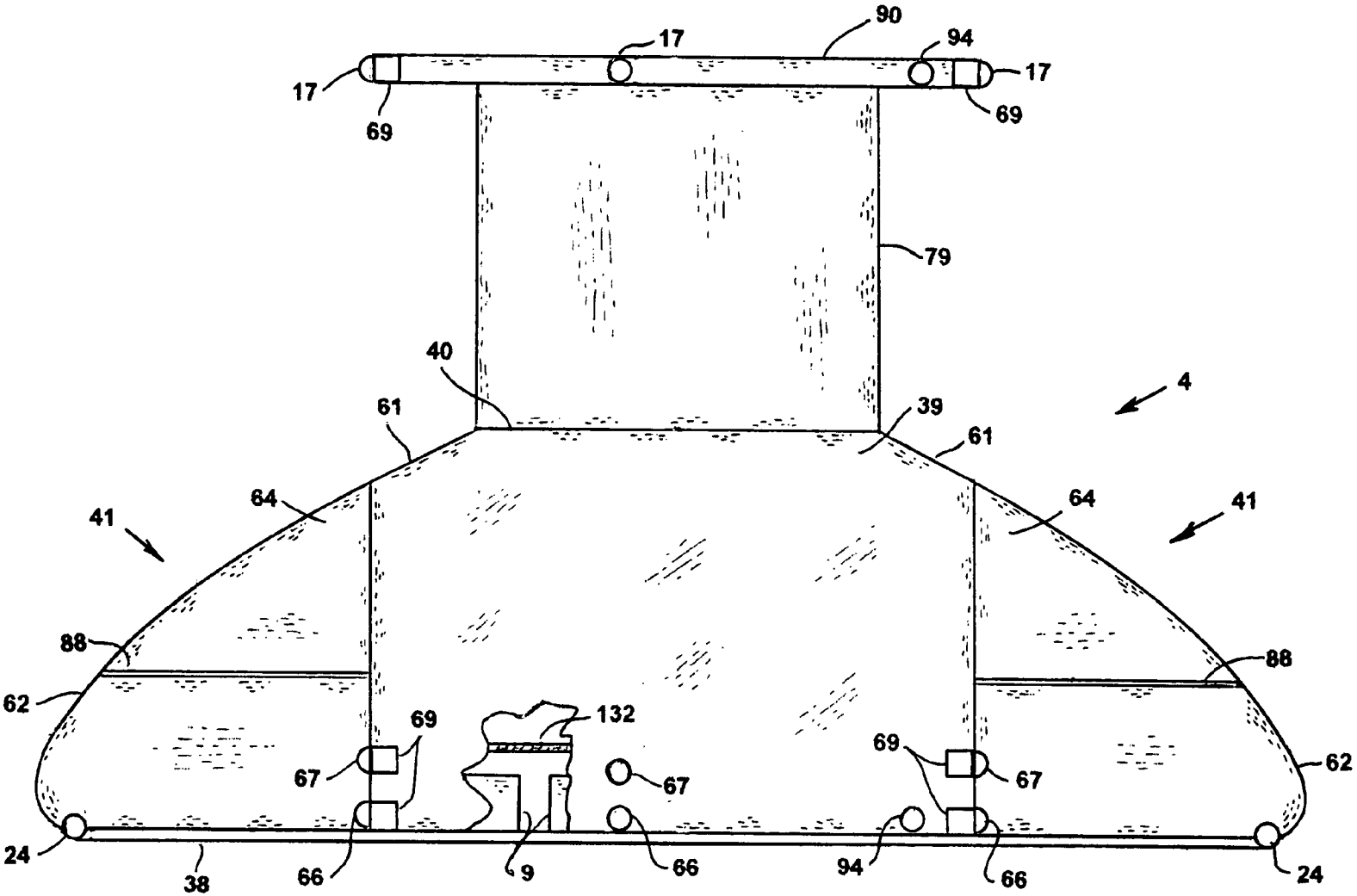
FIG. 9 shows a sectional side view of the control pod

Twelve connections between the other pontoon segments 32, 57, 112, 117 flexibly joined both by hinging means, hinges 26, as set out above, and with pivoting means 49, 50, 52, the adjacent ends of each pair of said pontoon segments 32, 57, 112, 117 being 1.5 feet apart, said pivoting means 49, 50, 52 for these twelve connections comprised of a cylindrical extension 50, in line with the central long axis, below the center of buoyancy of a first pontoon segment, centrally affixed to and extending from the end of said first pontoon segment and having a straight, round transverse hole 55 perpendicular to the center axis of said cylindrical extension 50, said hole 55 at a distance from and parallel to the end of said first pontoon segment, a flat thin bearing plate 49 having a central circular opening 52, a pair of hinges 26 horizontally affixed between said bearing plate 49, one each, on either side of said circular opening 52 and the end of a second pontoon segment, a retaining pin 53 fitable through said hole 55, said cylindrical extension 50 passing through said opening 52 and rotatably secured by said retaining pin 53, said pivoting means 49, 50, 52 permitting each of said twelve pairs of adjacent pontoons 32, 57, 112, 117 to pitch and roll independently as shown in FIGS. 8A-8D for the connection between two typical pontoon segments 32, 57, the maximum downward flexing angle 127 between the joined ends 86 of two pontoon segments 34, 57, 107, 112, 117 being 20 degrees as shown in FIGS. 7B, 8D.

Sixteen water tight flexible and/or elastic cylindrical surfaces, each termed a sleeve 27, the open ends circumferentially and flexibly sealed, attached to and surrounding the proximate ends 86 of each pair of hinged pontoon segments 32, 57, 107, 112, 117 reducing drag and increasing the displacement of the craft 1, as shown schematically in FIG. 7A, 7B, 8C, 8D, said sleeves 27 being pleated on their upper surfaces (not shown).

Climbup Means and Telfon Coatings

Figure 6A:
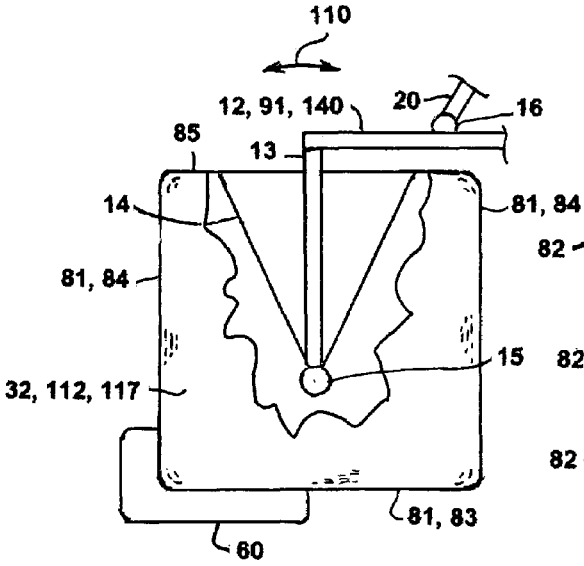
FIGS. 6A, 6C and 6D show sectional end views of a pontoon segment
Figure 6B:
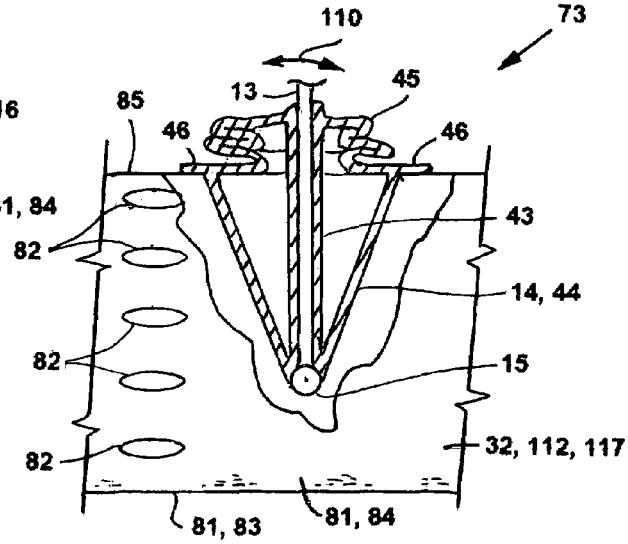
FIG. 6B shows a sectional side view of a pontoon segment

Climbup means, comprised of at least one vertical series of horizontal hand and foot holds 82, each of said hand and foot holds comprised of shallow indentations into, but not penetrating, each side of each of said pontoon segments 32, 57, 107, 112, 117, as shown schematically in FIG. 6B.

Said bottoms 83 and sides 84 of said twenty pontoon segments 32, 57, 107, 112, 117 are coated with a thin layer of teflon 81 reducing drag as shown schematically in FIGS. 6A-6D, 7A, 7B, 8A, 8C, 8D.

Table Lea Pivots and Hinges

Fourteen conical depressions 14, each having an upper circular base 3 feet in diameter, one each centered in the top 85 of each of said four adjacent pontoon segments 117, one each centered on the top 85 of each of said two outer middle pontoon segments 112, on the top 85 of each of said two Inner middle pontoon segments 107, and one each centered 6.5 feet from said inner end 86 on the top 85 of each end pontoon segment 32, each of said fourteen conical depressions 14 respectively extending vertically downward from each of said tops 85 respectively to a pivot 15 pivotally affixed and supported within said pontoon segment 32, 112, 117, by support means (not shown) below the center of buoyancy of its respective pontoon segment 32, 112, 117, two pairs of hinge slots 111 each 3 feet long and 5 inches wide, a pair of said hinge slots 111 being parallel, centered on each other and spaced apart 4.5 feet, the long axes of said pair of hinge slots 111 centered on said top 85 and perpendicular to the length of each of said inner middle pontoon segments 107 and extending outboard, each of said hinge slots 111 each respectively tapered downward from the top 85 to a slot hinge 119, each of said pair of slot hinges 119 respectively affixed within each of said inner middle pontoon segments 107 by affixing means (not shown) below the center of buoyancy, said depths of said slot hinges 119 and of said conical depressions 14 from their respective tops 85 all being equal as shown generally in FIGS. 6A-6D. In each of said FIGS. 6A-D, motion arrows 110 indicate movement of one of said table legs 13.

Six triangular tables 12, 140, four end tables 12 and two center tables 140, each of said tables 12, 140 comprised of a flat horizontal triangular plate 91 and three vertical straight table legs 13, each of said table legs 13 respectively attached to and extending downward from said tops 85 each of said three corners of said table 12, 140, the top 91 of each of said two center tables 140 being comprised of an isosceles triangle, the base of said isosceles triangle being 4.5 feet long and the length of said isoceles triangle being 6.5 feet long, the base of each of said center tables 140 respectively being parallel to the long axis of said inner middle pontoon segments 107 and each of said corners of said base being respectively centered over said hinge slots 111 and slot hinges 119, said length of said isoceles triangle extending centrally and horizontally outboard perpendicular to the long axis of said inner middle pontoon segment 107, the third corner of said top 91 centered over said conical depression 14 in said top 85 of said outer middle pontoon segment 112, the bottom of said legs 13 of said four end tables 12 and of said two outboard legs 13 of said two center tables 140 each respectively rotatably and pivotally affixed to said pivots 15 in said pontoon segments 32, 112, 117 and the bottoms of each of said four inboard legs 13 of each of said two center tables 140 respectively affixed and hinged to said slot hinges 119, whereby said fourteen table legs 13 affixed to said pivots 15 respectively freely pivot and rotate within said conical depressions 14 and said four table legs 13 respectively affixed to said slot hinges 119 respectively freely move laterally within each of said hinge slots 111.

Pivot Bags and Slot Sleeves

Fourteen flexible enclosures, each termed a pivot bag, indicated by the general reference number 73, each of said pivot bags 73 contained in one of said fourteen conical depressions 14, one each in the top 85 of said fourteen pontoon segments 32, 112, 117, and each comprised of a thin conical layer 44 congruent with and in contact with the inner surface said conical depression 14 and concentrically affixed at its bottom end to an upright tubular extension 43, said tubular extension 43 extending upward from said pivot 15 and surrounding said pivoted table leg 13 to the top 85 of each of said pontoon segments 32, 112, 117, a continuous series of at least one, but preferably two or more concentric bellows 45, said two or more bellows 45 progressively smaller toward the topmost bellows 45, the outer lower circular edge of the lowest bellows 45 extended peripherally and affixed to the circular top edge of said conical layer 44, the inner circular top edge of said bellows 45 extending concentrically inward to and surrounding the upper portion of said table leg 13 proximate to the bottom of said table 12 and concentrically affixed to the top of said tubular extension 43, forming a continuous flexible enclosed toroidal volume within said conical depression 14, the top circular edge of said conical layer 44 extending peripherally a short distance, an extension 46, the bottom surface of said extension 46 affixed to the top 85 of said pontoon segment 32, 112, 117 as shown in FIG. 6B.

Figure 6C:
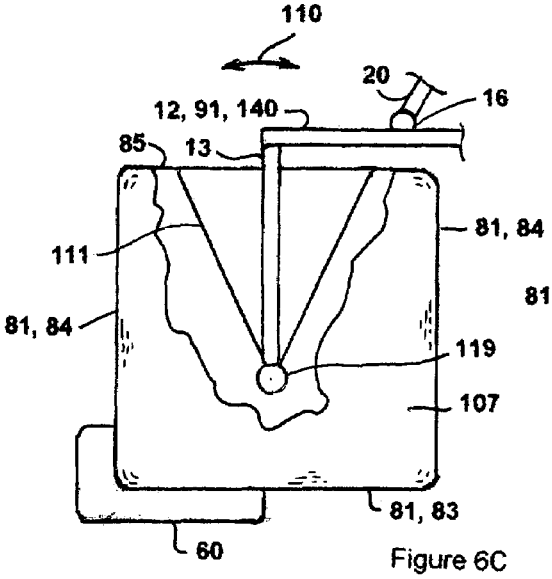
Figure 6D:
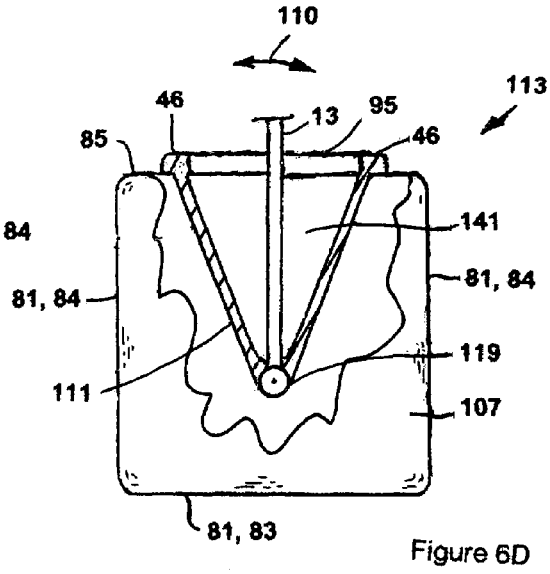

Four triangular slot sleeves indicated by the general reference number 113, one each contained in each of said four hinge slots 111 and each comprised of two triangular pieces, termed sides 141, the tops of said two pieces being horizontal forming a narrow opening. 95, the outer lower edges of said sides 141 joined and at their bottom ends concentrically terminating at and around said slot hinge 119, the tops of each of said two pieces 141 extending outward a short distance, an extension 46, the bottom surface of each of said extensions 46 affixed to the top 85 of said pontoon segment 107 as shown in FIG. 6D.

Propulsion Means

At least one pair of propulsion means 60 mounted in a pair of pontoon segments 32, 57, 107, 112, 117 on symmetrically opposing sides of the craft 1 in either or both of said long pontoons 30, 31, said at least one pair of propulsion means 60 comprised of a water jet thrust means (not shown) and/or a horizontally rotatable cowelled electric motor driven propeller means (not shown) and/or an engine driven propeller (not shown), said propulsion means 60 creating controllable thrust at an end, below and/or on either or both sides of said at least one pair of pontoon segments 32, 57, 107, 112, 117 as shown schematically in FIGS. 6A, 6C. As would be obvious to one skilled in the art, the dimensions and specifications of said long pontoons 30, 31 may require modification to accommodate said propulsion means 60. The preferred arrangement is to have two motor-generator units 138 (not shown) in each inner base pontoon segment 10, one each on either side of said slot hinges 119, said motor-generator units 116 providing onboard power and power for propulsion using electric motor driven props (not shown). Fuel bags (not shown) are contained in some or all of said pontoon segments 32, 57, 107, 112, 117.

Control Pod

Figure 5A:
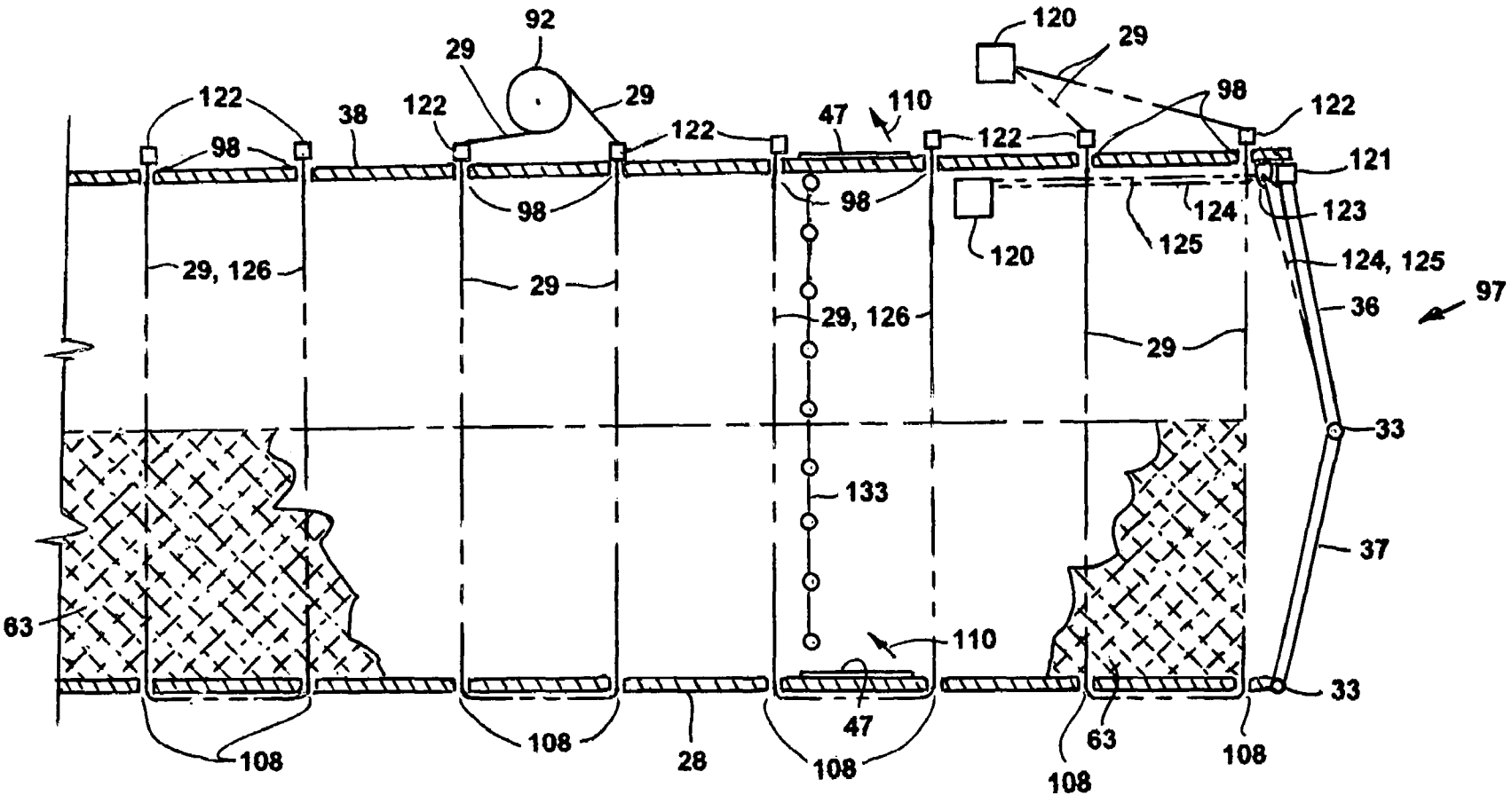
FIG. 5A shows a partial side view of a lowered bottom compartment
Figure 5C:
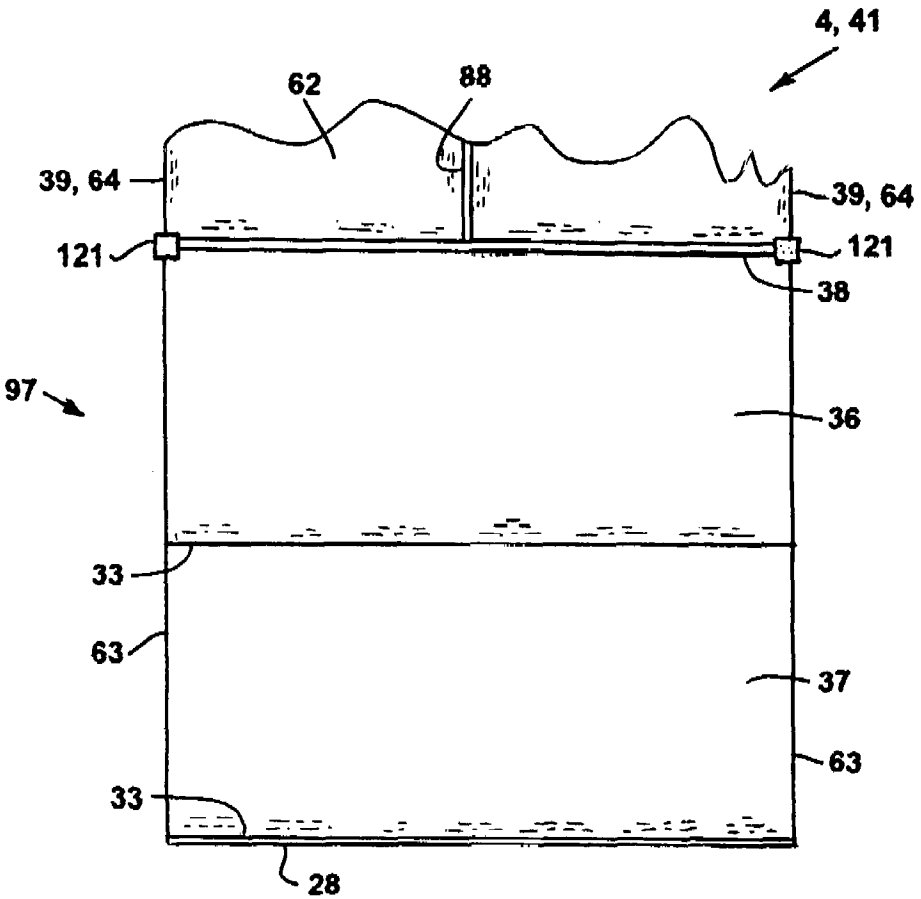
FIGS. 5B, 5C show a partial side view and an end view of a lowered bottom compartment
Figure 5B:
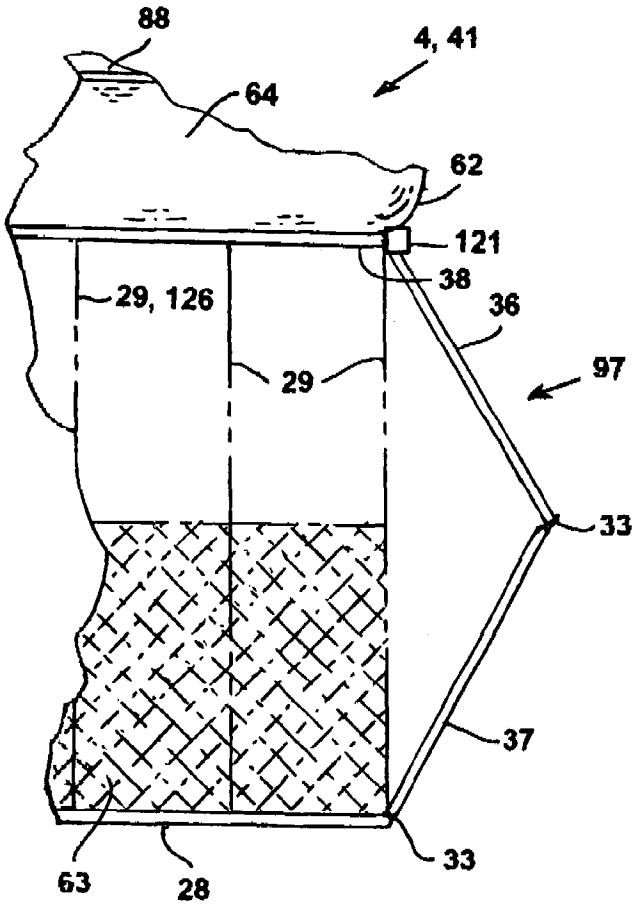
Figure 10A:
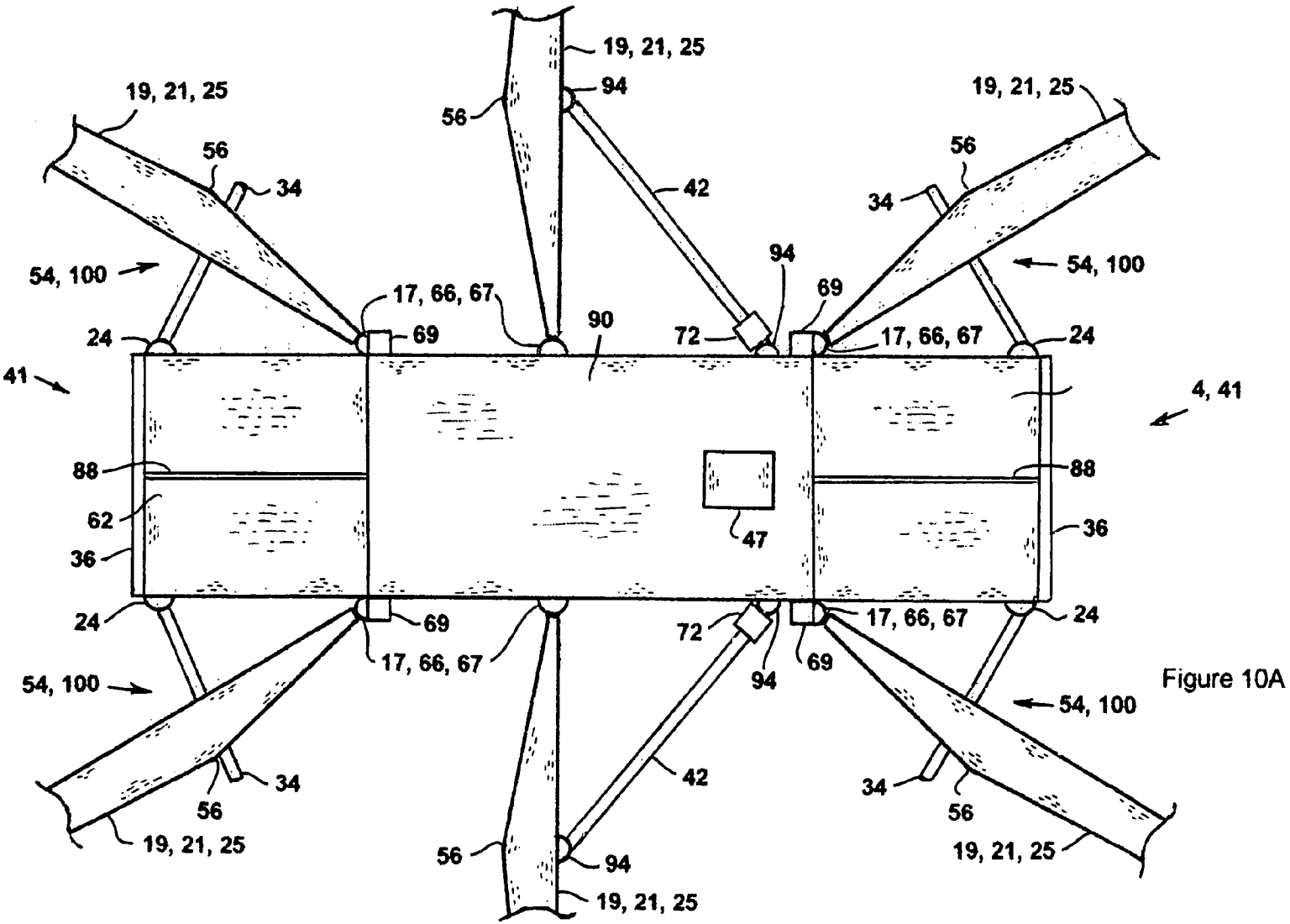
FIG. 10A shows a top view of the control pod
Figure 10B:
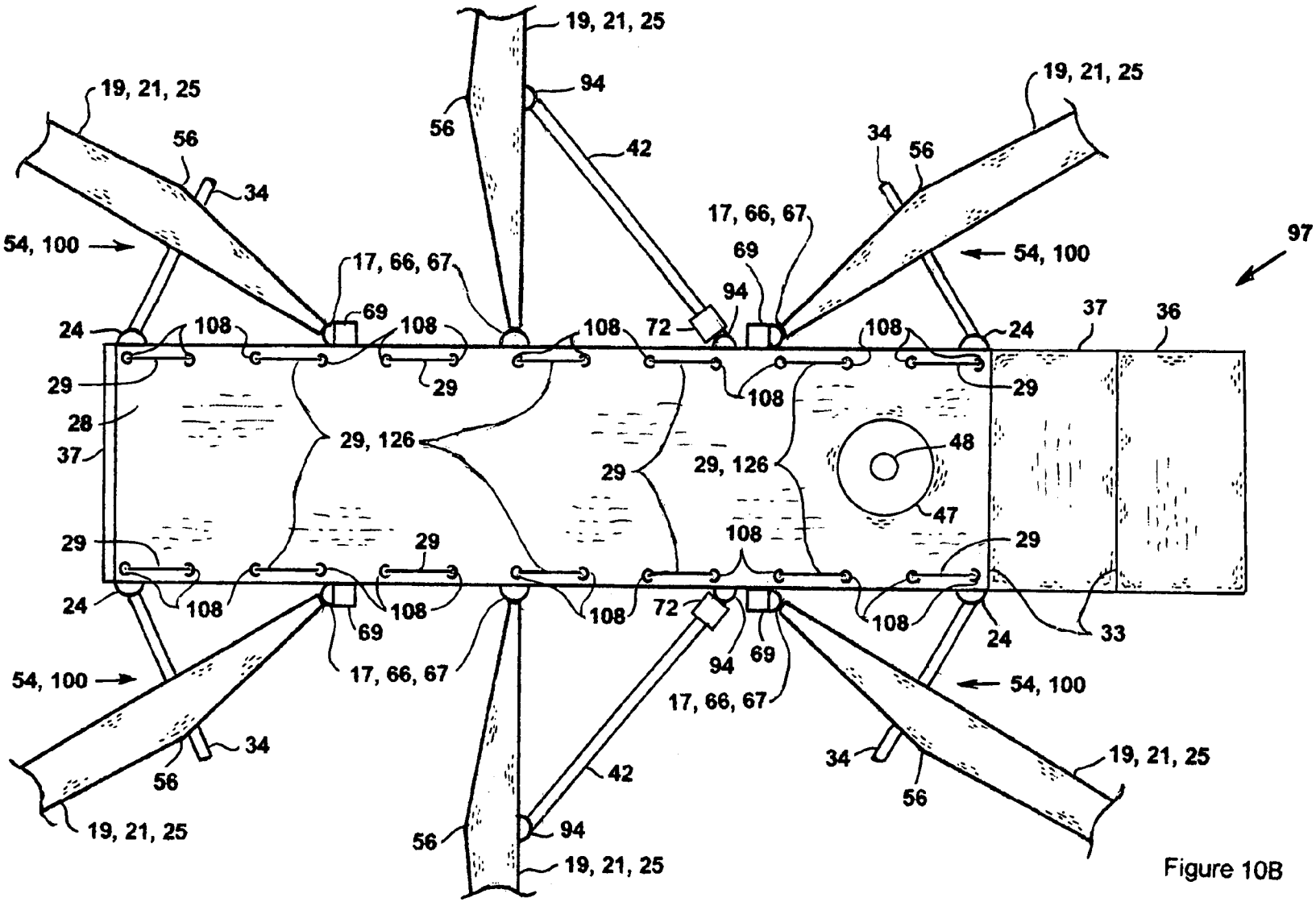
FIG. 10B shows a bottom view of the retractable platform

Said control pod 4, an enclosure comprised of a first horizontal rectangular plate, termed a bottom plate 38, twenty-four feet long and 6.5 feet wide, two parallel vertical plates, termed side plates 39, twelve feet long and eight feet high and linearly tapered at their upper outer ends down to seven feet in height from a horizontal inset of two feet from each end, the lower edges of said two vertical plates 39 centered on and affixed to either side of said bottom plate 38, a second horizontal plate, termed the top plate 40, parallel to and centered above said bottom plate 38, said top plate 40 being 6.5 feet wide and eight feet long, said top plate 40 centrally affixed outboard, on either side, to the upper edges of said two vertical plates 39, two flat rectangular sloping plates, termed end plates 61, 6.5 feet long and 2.83 feet wide, the inner edge of each of said end plates 61 affixed to an outer edge of said top plate 40 and extending downward and outward, the outboard edges of each of said end plates 61 respectively affixed to the sloping top edges of said side plates 39, two clear enclosing surfaces indicated by the general reference number 41, one on each end of said control pod 4, each of said enclosing surfaces 41 comprised of three clear thin pieces, ½ inch thick lexan, said three pieces comprised of a clear curved front piece 62 and two vertical triangular parallel clear sides pieces 64, said front piece 62, a inverted wing foil shape, affixed along and extending the horizontal plane of said lower outer edge of said bottom plate 38 outward and recursively back and upward toward the top center of said control pod 4 terminating in a horizontal edge perpendicular to the long axis of said control pod 4 and affixed to the outer horizontal edge of said end plate 61, said two side pieces 64, affixed along their bottom horizontal edges to the outer edge of said bottom plate 38 on each side and affixed, on each side, along their inner vertical edges to the vertical outer edge of said side plate 39, the outer upper edge of each clear side plate 64 smoothly and continuously joining the outer edges of said front piece 38 on each side, a rigid cylindrical tube, termed the top cylinder 79, having horizontal parallel ends perpendicular to its vertical central axis, the cross section of said top cylinder 79 being elliptical, the long axis of said top cylinder 79 lying centered along and parallel to the length of said control pod 4, the bottom end of said top cylinder 79 being centrally affixed to said top plate 40, said cylindrical tube 79 being 6 feet high and the axes of said elliptical cross section being 8 feet long by 5 feet wide, a flat rigid rectangular plate, termed the top rack 90, 6.5 feet wide and 12 feet long being centrally affixed to the top of said top cylinder 79, at least one access hatch or door 47 in said top plate 40 and in said top rack 90, at least one access hatch or door 47 in each of said four side pieces 64, at least one hatch or door 47 in said bottom plate 38, a hoist 48 affixed to the bottom of said top plate 40 centered over said at least one access hatch or door 47 in said bottom plate 38, said at least one bottom central access hatch 47 being round and 3 feet in diameter, as shown schematically in FIG. 10B, 28 holes 108 spaced apart and along the outer edges of said bottom plate 38, fourteen on each side, two impact guards 88 congruent to and proximate to each of said Texan surfaces 41, each of said guards 88 comprised of a rigid structure congruent with and attached over each of said front pieces 62 and said two side pieces 64, said structure comprised of a first rigid member extending outward and upward from the bottom center outer edge of said bottom plate 38 over said front piece 62 and affixed at its inner upper end to the front center of said end plate 61 and of a second rigid member extending outward horizontally from the middle of each of the outer vertical edges of said side plates 39 and then extending horizontally inward over said front piece 62 and affixed to said first rigid member as shown in FIGS. 1, 3, 4, 9, 13A, 13B, 15, 28 holes 98 spaced apart and along the outer edges of said bottom plate 38, fourteen on each side from one corner to the other as shown in FIG. 5A, four rigid loops, termed ramp cable holes 123, one each affixed at each lower exterior corner of said bottom plate 38 as shown in FIG. 5A.

Figure 15:
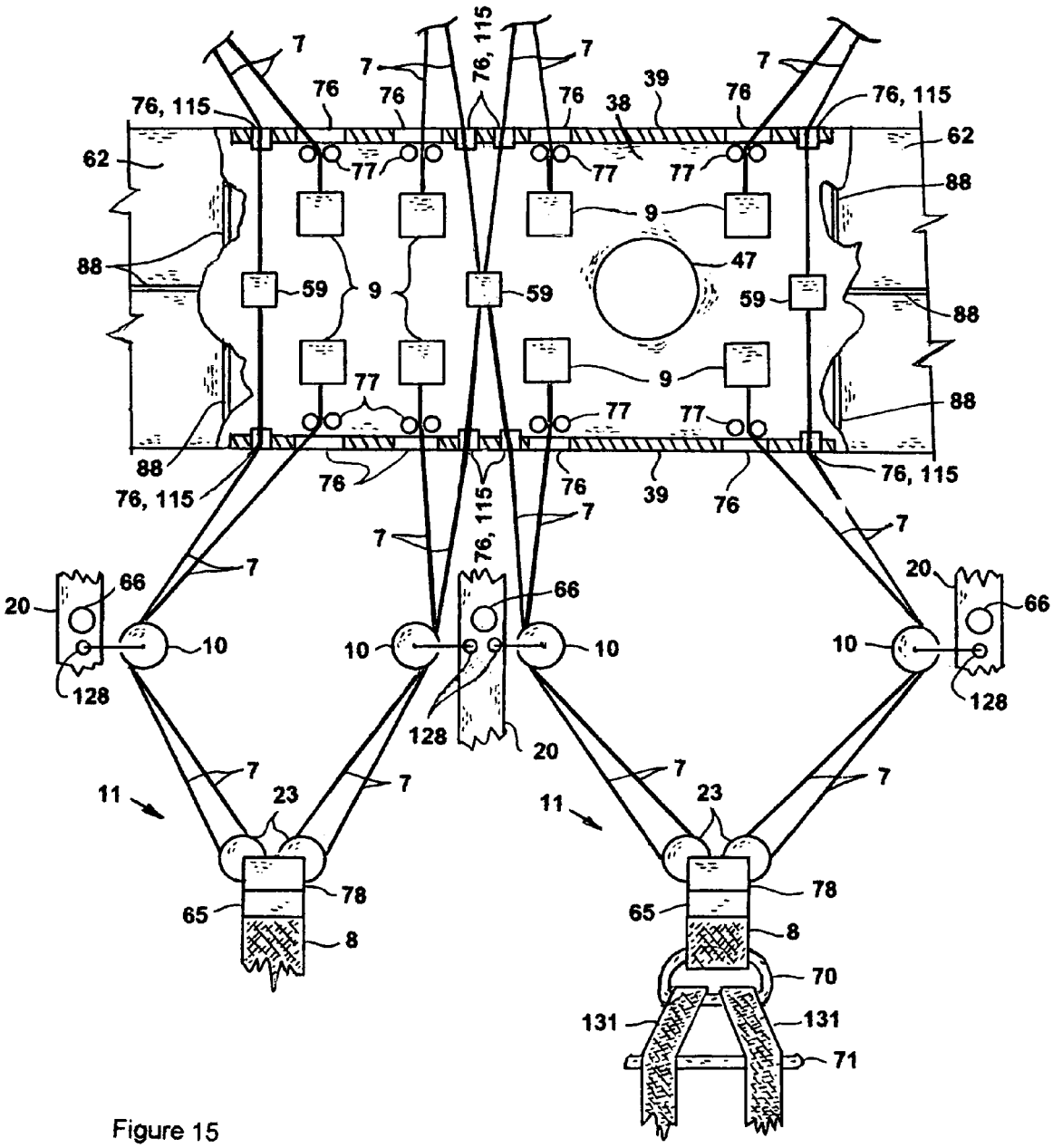
FIG. 15 shows a schematic top view of support cable routing and slings

Eight winches 9, respectively controllably winching the ends of eight load cables 7, ½ inch diameter stainless steel cables as shown schematically in FIG. 15, said eight winches 9 affixed to the top of said bottom plate 28 inside said control pod 4, three cable securement means 59 centrally affixed to the top inside surface of said bottom plate 38, one affixed in the center and the other two outward of the two outer winches 9 on each side, sixteen openings 76, eight spaced apart on and through the lower side of each of said side plates 39, four of said eight openings on each side respectively adjacent to each of said four winches 9 and two of said eight openings on each side respectively adjacent to said two outward cable securement means 59 and two of said eight openings on each side adjacent to said center cable securement means 59 as shown schematically in FIG. 15, four cable roller guides respectively adjacent to each of said four winches 9 one each in each of said four openings 76 adjacent to said winches 9, each of said roller guides comprised of two pairs of rollers, each pair proximate to, displaced apart and at right angles to the other pair and each in one of said openings 76 as shown schematically in FIGS.

15, 18A, 18B, said cable roller guides 77 each supporting and guiding one of said support cables 7, eight cable rests 115, four on each side of said control pod 4, each rest 115 comprised of a cube shaped block smoothly recessed with a groove on top by ½ inch and said groove oriented outward, one each in one of said four openings on each side and adjacent to said cable securement means 59, two centrally and one each outward of each of said outer roller guides 77 as shown schematically in FIG. 15, a horizontal rectangular rigid plate, termed a walk-on plate 132, 6.5 feet wide and 12 feet long, parallel to and centered 1.5 feet above said bottom plate 38 and above and proximate to said winches 9 and affixed on its outer edges to the inside of each of said side plates 39, at least one hatch 47 in said walk-on plate 132, said at last one hatch 47 congruent with and centered on said hatch 47 in said bottom plate 38, eight hatches 47 (not shown) in said walk-on plate 132, one each centered over each of said winches 9, two pairs of centered outward facing seats 147 (not shown), two at each end of said control pod 4 within said clear enclosure 41.

Lower Retractable Compartment

Figures 5D, 5E, 5F:
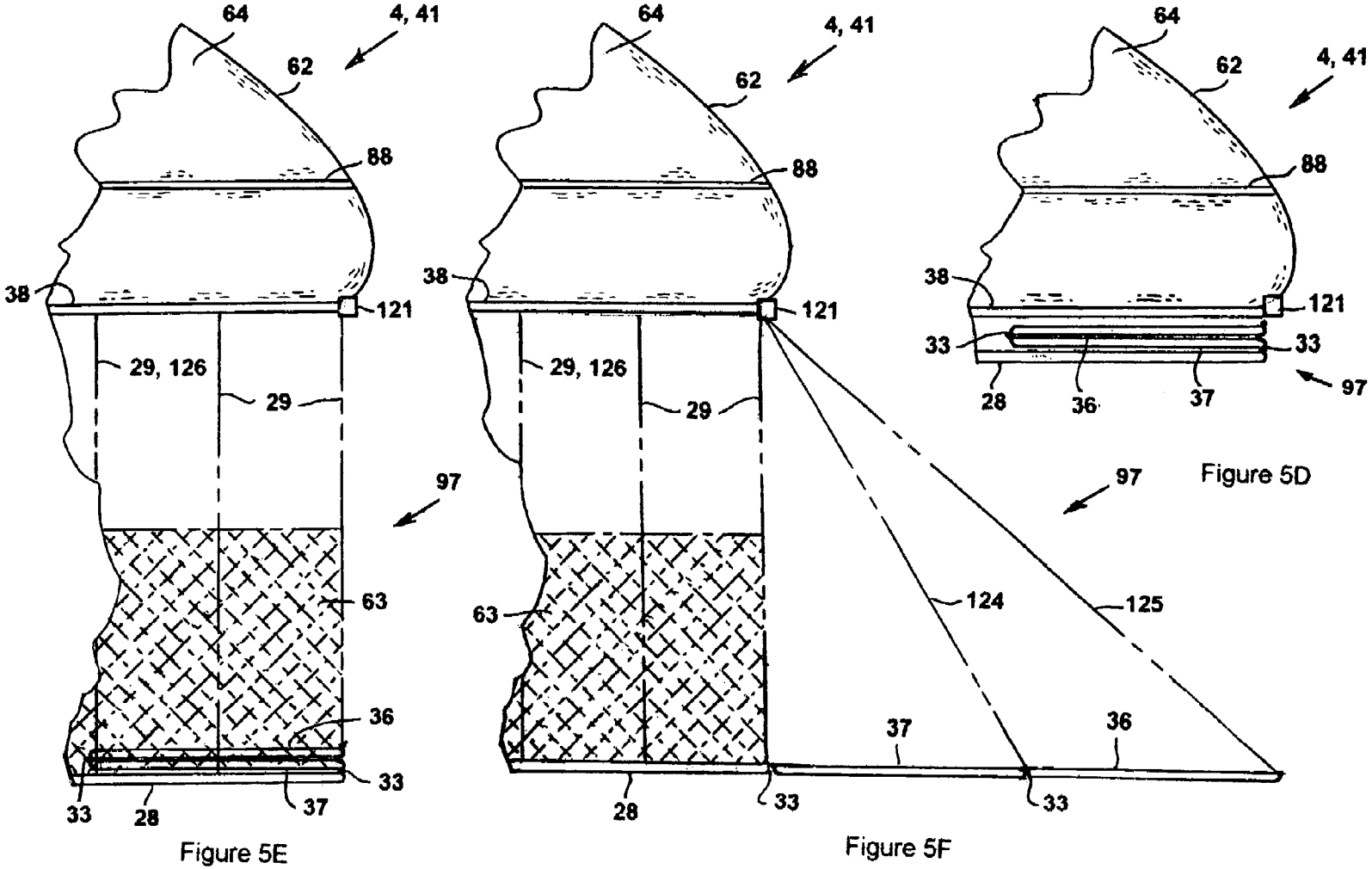
FIGS. 5D-5F show partial side views of the end of a bottom compartment

A bottom compartment indicated by the general reference number 97 comprised of a rectangular plate, a bottom platform 28, 6.5 feet by 24 feet, contiguous with and just below said bottom plate 38, 14 pairs of holes 108 spaced apart and along the outer edges of said platform 28, 14 on each side from one corner to the other, at each end of said retractable bottom platform 28, 14 pairs of platform cables 29, ⅜th inch diameter stainless steel cable, seven pairs on each side of said platform 28, each of said pairs passing its ends upward, on each side, through said 7 pairs of holes 108, along the sides of said platform 28, the middle of each of said pair of cables 29 centered at and below said platform 28 between each pair of said holes 108 and, for each of said cables 29, its ends extending upward vertically through said corresponding holes 98 in and along the outer edges of said bottom plate 38, swages 122, one each affixed to each of said cable 29 ends just above and at the top of said bottom plate 38 at and above each of said holes 98, said swages 122 limiting the downward movement of said cables 29 through said holes 98 and with 6.5 feet of free length for each cable 29 between said bottom plate 38 and said platform 28, four interior pairs of said cables 29, two pairs on each side with one pair on either side of the central pair, retractable by retracting means 92 as shown schematically in FIG. 5A, each of said four retracting means 92 affixed to the top of said bottom plate 38, four outer pairs of said cables 29, one pair at each corner of said bottom plate and respectively passing upward through said holes and manually securable within said control pod 4 by manual cable securing means 120 shown schematically in FIG. 5A, two flat rectangular plates, each termed a lower end plate 37, being 6.5 feet wide by 3.5 feet, each affixed and rotatably hinged 33 about its lower horizontal edge to an one end of said retractable bottom platform 28, and said lower end plate 37 rotatably hinged 33 about a horizontal axis along its upper edge to one of two second rectangular plates, each termed an upper end plate 36, being 6.5 feet wide by 3.5 feet, along its lower edge, said upper end plate 36 removably attached by manual affixing means 121 (not shown) at its upper edge to the outer edge of said bottom plate 38, said upper end plate 36 and said lower end plate 37 foldable outwardly or inwardly and when folded inwardly, fitting compactly between said bottom plate 38 and said platform 28 when said platform 28 is elevated as shown in FIG. 5D, four pairs of ramp cable 124, 125, ⅜ inch diameter stainless steel cable, each of said pairs comprised of one long ramp cable 124 and one short ramp cable 125, two pairs at each end of said bottom compartment 97, one pair affixed at each corner on each side, one end of said long ramp cable 124 of a pair affixed to the top outer corner of said upper end plate 36 and one end of said short ramp cable 125 of said pair affixed to the bottom outer corner of said upper end plate 36 at the outboard end of said hinge 33 between said top plate 36 and said bottom plate 37, said pair of ramp cables 124, 125 passing upward and through a proximate rigid loop 123, at least one swage 122 (not shown) affixed to each of said cables 124, 125 above said loop 123 and securing said cables 124, 125 from outward movement with 7.53 feet of free length for said short ramp cable and 8.824 feet of free length for said short ramp cable outward of said loop 123, said free lengths retractably securable through said rigid loops 123 below said bottom plate 38 by manual securing means 120 shown schematically in FIG. 5F, whereby when said platform 28 is lowered and when said upper end plate 36 is released from said bottom plate 38 by said manual securing means 121 and when said cables 124, 125 are extended by releasing said manual securing means 120, said cables 124, 125 are restrained from further outward movement by said swages 122, said ramp cables 124, 125 supporting said upper end plate 36 and said lower end plate 37, said plates 36, 37 in an extended outward level position, as shown in FIGS. 5F, 10B, said middle pair of cables 29 and said two pairs of cables 29, one each inward of said outer pairs at each end of said bottom compartment 97, a total of three pairs of said cables 29, 126 on each side, said free lengths of 6 feet each being non-retractable and loose within and between said bottom plate 38 and said bottom platform 28 when said bottom platform 28 is elevated, webbing or canvas coverings 63 affixed to the lower half of said 14 platform cables 29 on each side enclosing the lower half of the open sides of said partially enclosed space as shown in FIGS. 5A, 5B, 5E, 5F, a hatch 47 in said bottom platform 38 congruent with said hatch 47 in said bottom plate 28 as shown in FIG. 10B, a rope ladder 133 affixed at and extending downward from one side of said hatch 47 in said bottom plate 38 to said bottom platform 28 as shown in FIG. 5A.

Control Pod Pivots

Twelve pivot mount extensions 69, each comprised of a cube four inches on a side, the exposed edges of said extensions 69 being rounded, four of said extensions 69 mounted outboard, two on each side, to said top rack 90 at the outer corners, four of said extensions 69 mounted outboard, two on each side, to the lower corners of said side plate 39, four of said extensions 69 mounted outboard, two on each side, each 4 inches above said extensions mounted in the lower corners of said side plate 39, six bottom pivots 66, three on each side of said side plate 39, one each of said three bottom pivots 66 affixed, facing outward, to the outward side of each of said bottom corner extensions 69 and the third of said bottom pivots 66 affixed, facing outboard, to said side plate 39 five inches forward of the middle of said side plate 39 and in line with and between said two bottom corner extensions 69, six power pivots 67, three on each side of said side plate 39, one each of said three power pivots 67 affixed, facing outward, to the outward side of each of said upper extensions 69 and the third of said power pivots 67 affixed, facing outboard, to said side plate 39 five inches forward of the middle of said side plate 39 and in line with and between said two upper extensions 69 to which said two power pivots 67 are respectively affixed, six top pivots 17, three on each side of said top rack 90, one each of said three top pivots 17 affixed, facing outward, to the outward side of each of said extensions 69 and the third of said top pivots 17 affixed, facing outboard, five inches forward of the middle of the side of said top rack 90 and in line with and between said two extensions 69, to said top rack 90, four middle brace pivots 94, one each affixed, facing outboard, on each side to said side plate 39 inward by 5 inches of said rear bottom corner extension 69 and one each affixed, facing outboard, on each side to said top rack 90 inward by 5 inches of said rear corner extension 69, four outer brace pivots 24, one each affixed, facing outboard, on each corner of said bottom plate 38, as shown in FIGS. 9, 10A, 10B, 13A.

Articulatable Support Legs

Said four outer supporting legs 5, two on each side, one each respectively affixed to and supported by said pivoting means 16 on the top 91 of each of said four end tables 12 and said two middle supporting legs 5, one on each side, one each respectively affixed to and supported by said pivoting means 16 on the top 91 of each of said two center tables 140, each of said six supporting legs 5 comprised of a first rigid member pivotably and rotatably affixed to and angled upward from said pivot 16, termed a vertical strut 20 and being 23 feet high, the upper end of said vertical strut 20 rotatably connected by hinged affixing means, termed a knee hinge 18, to a second rigid member, termed a top strut 21, said top strut 21 respectively pivotally connected at its inner end to one of said top pivots 17, said top strut 21 of each of said two middle legs 5 being 19.0 feet long and each of said top struts 21 of each of said four outer legs 5 being 25.8 feet long as shown in FIGS. 4, 10A, 10B, 12A, each of said legs 5 further comprised of a third rigid variable length member, termed a bottom strut 25, adjustable from a minimum length of 19 feet to a maximum length of 24 feet by hydraulic adjusting means 75 as shown schematically in FIG. 4, the outer end of each of said six bottom struts 25 respectively pivotably and rotatably affixed inboard seven feet below their respective knee hinges 18 to said vertical struts 20, at a pivot 66, each of the inboard ends of said bottom struts 25 respectively pivotally and rotatably affixed to said inboard pivot 66 as shown in FIGS. 4, 10A, 10B, 12C, each of said legs 5 further comprised of a fourth variable length member, termed a power strut 19, adjustable from a minimum length of 18 feet to a maximum of 25 feet by hydraulic means 75 for each of said two center legs and adjustable from a minimum length of 24 feet to a maximum length of 29 feet by hydraulic means 75 for each of the four outer legs 5, each of said power struts 19 respectively pivotally and rotatably affixed at its outboard end six inches below said knee hinge 18 to the inboard surface of said vertical strut 20 at said pivot 67 and respectively pivotally and rotatably affixed at its inboard end to said inboard pivot 67, as shown by FIGS. 4, 10A, 10B, 12B, variations in the length of said power struts 19 and/or said bottom struts 25 altering the height of the control pod 4 and/or the span of the craft 1, six springs 72, one each affixed at the outboard end of each of said six bottom struts 25 dampening lengthwise motion of each of said bottom struts 25 by plus or minus 4.5 inches, six springs 72, one each affixed at the inboard end of each of said six power struts 19, respectively permitting lengthwise extension or contraction of each of said power struts, while under load, by at least plus or minus two feet.

Four middle braces 42, each comprised of a round straight rigid shaft, two of said middle braces 42, one each respectively pivotally affixed at its inboard end to said pivot 94 on each side of said top rack 90 and pivotally affixed at its outboard end to said middle top strut 21 six feet from the inboard end of said middle top strut 21, and two of said middle braces 42, one each respectively pivotally affixed at its inboard end to said pivot 94 on each side of said side plate 39 and pivotally affixed at its outboard end to a pivoting means 94 to said middle bottom strut 25 six feet from the inboard end of said bottom top strut 25, four dampening springs 72, one each at the inboard end of each of said middle braces at said pivoting means 94 dampening lengthwise motion of each of said middle braces 42 by plus or minus 4.5 inches as shown schematically in FIGS. 4, 10A, 10B, 12A, 12C.

Figure 13A:
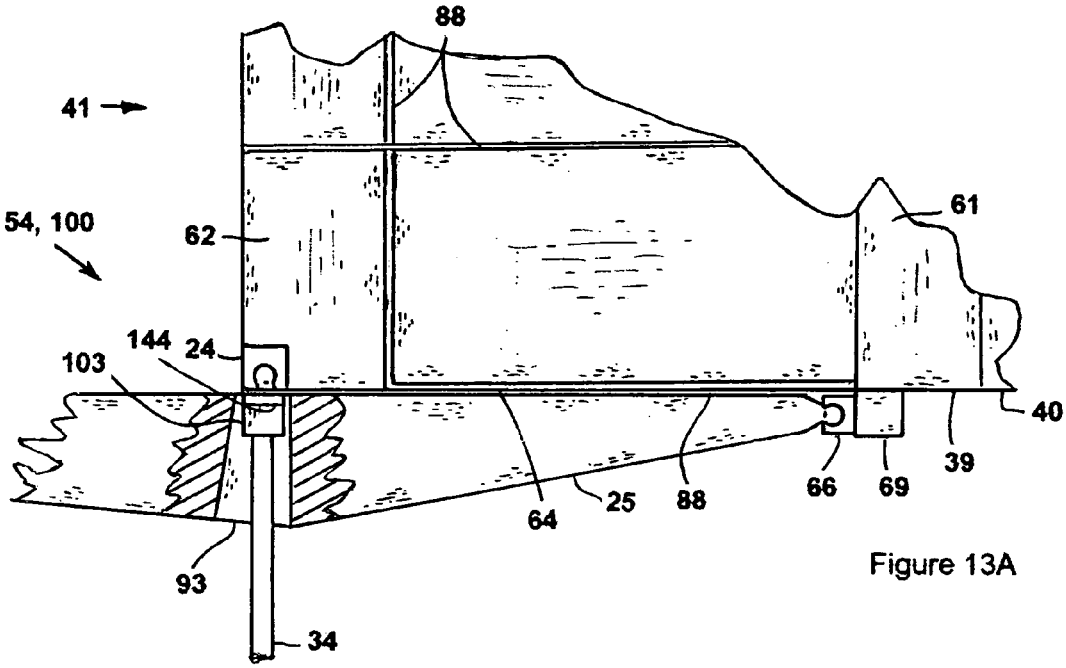
FIGS. 13A, 13B show a partial top view and a side view of an outer bottom brace and bottom strut
Figure 13B:
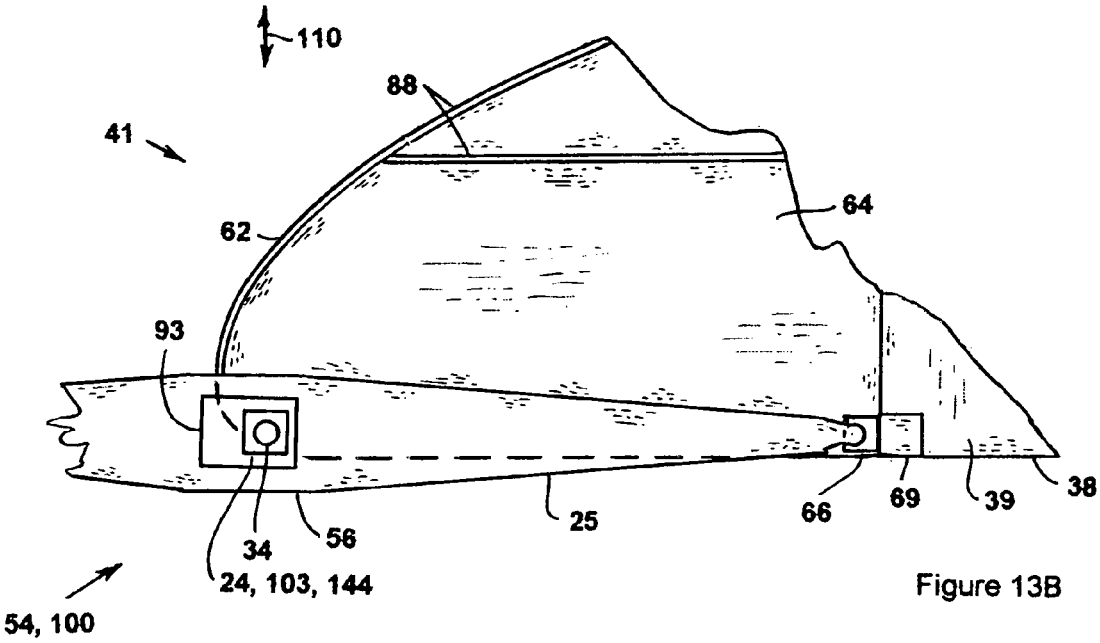
Figure 14A:
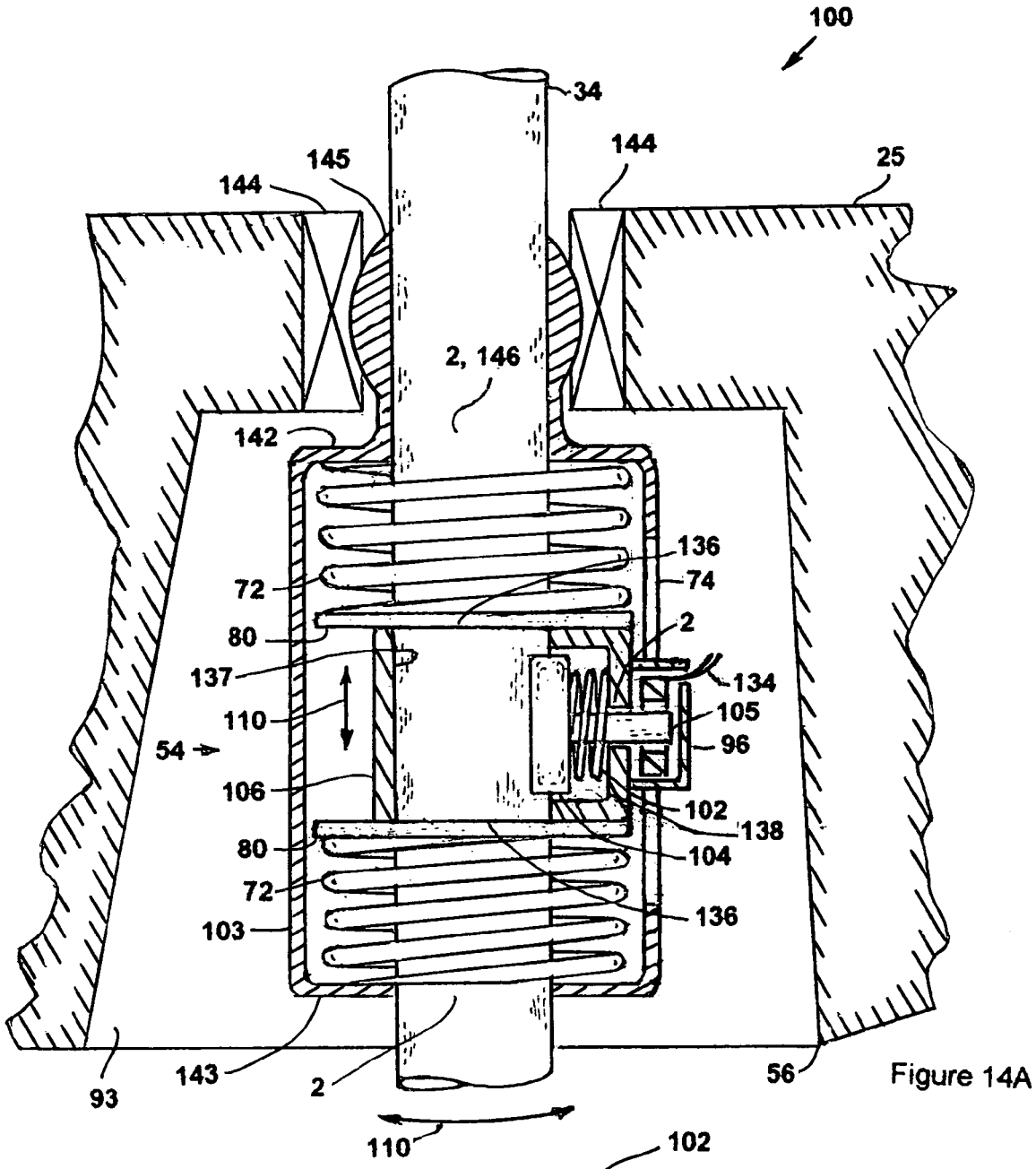
FIGS. 14A, 14B show a sectional top view and a sectional end view of a solenoid clamp assembly
Figure 14B:
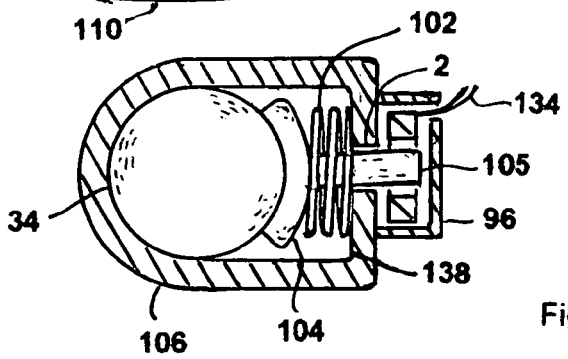
Figure 14C:
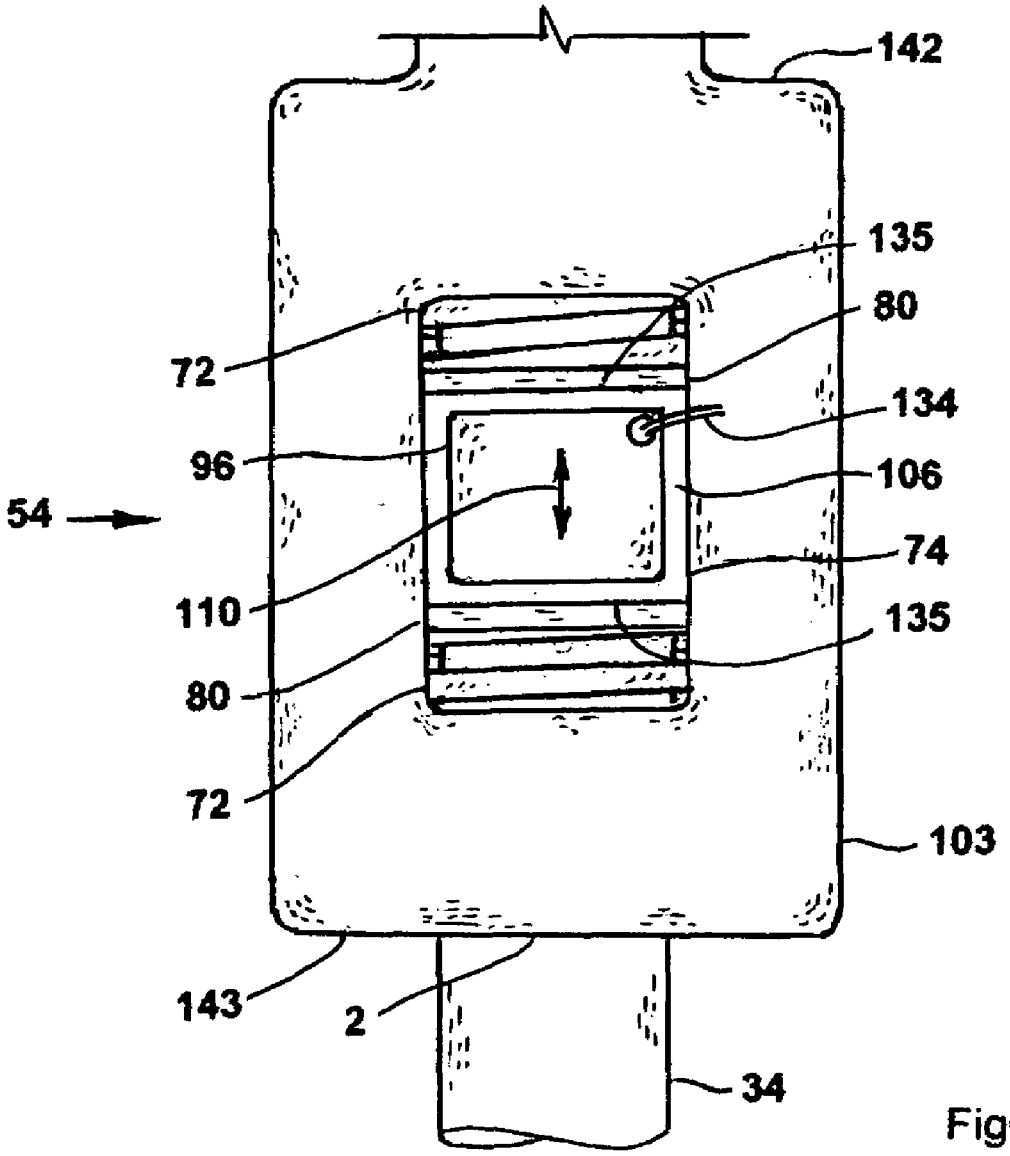
FIG. 14C shows an outward view of a spring housing

Four outer braces 34, each comprised of a round straight rigid shaft, one each pivotally affixed at each of the bottom corners of said bottom plate 38 at one of said corner pivots 24, each of said outer braces 34 extending horizontally outboard when said bottom struts 25 are level, four openings, each termed bottom strut openings 93, each of said openings 93 respectively centrally and horizontally penetrating the width of each of said four outer bottom struts 25, the axis of each of said openings 93 perpendicular to the long axis of said outer bottom strut 25 and said axis being six feet outward from said outer bottom struts 25 inner point of attachment at said inboard pivot 66, each of said openings 93 respectively centrally tapered outboard through said outer bottom struts 25, four axial pivots indicated by the general reference number 100 shown schematically in FIGS. 13A, 13B, 14A, one each respectively secured to each of said outer bottom struts 25 within, and at the inner surface of, each of said openings 93, each of said axial pivots 100 comprised of a spherical base 144 centrally mounted within said opening 93, a spherical bearing 145 pivotably contained within said spherical base 144 and concentrically extending outboard, a round hole 146 centrally penetrating said spherical bearing 145, said hole 146 surrounding and slidably supporting said outer brace 34, each of said outer braces 34 respectively passing through one of said holes 146 and through said outer bottom strut 25, a clamp assembly indicated by the general reference number 54 comprised of a cylindrical enclosure, termed a spring housing 103, said spring housing affixed on its inboard end to a first circular plate 142 and affixed on its outboard end to a second circular plate 143, said plates 142, 143 each having a centered hole 2 therein, said holes 2 in said plates 142, 143 concentrically surrounding said outer bottom strut 34 and said inner plate 142 affixed to the outer end of said spherical bearing 145, said hole 2 in said inner plate 142 being continuous with said hole 146 in said spherical bearing 145, a lengthwise slot 74 in said spring housing 103 parallel to said outer brace 34, an enclosure, termed a clamp housing 106, said damp housing 106 contained within said spring housing 103, said clamp housing 106 being cube shaped and comprised of six sides, two opposing sides 135 of said clamp housing 106 being flat and parallel, two round axially centered holes 136 through said opposite sides 135 of said clamp housing 106, said holes 136 concentrically surrounding said outer brace 34, the inner surface of the outer side of said clamp housing 106, termed a curved side 137, affixed to and connecting each of said two opposing sides 135 and in contact with the outer half of said outer brace 34 within said clamp housing 106, the interior of said clamp housing 106 proximally enlarged inner and proximal side, termed the interior side 138, connecting and affixed to each of said two opposing sides 135, a centered hole 2 perpendicular to the axis of said outer brace 34 in said interior side 138, a short rigid cylindrically curved plate 104, within said clamp housing 106, the inner surface of said plate 104 in contact with and congruent to the inner side of said outer brace 34 opposite to said curved side 137, the center of the outer surface of said curved plate 104 centrally proximate to said hole 2 in said interior side 138, a solenoid shaft 105 affixed perpendicularly and centrally to said outer side of said curved plate 104 and passing outward through said hole 2, a spring 102 positioned around said shaft 105 inside said housing clamp 106 between the outside of said curved plate 104 and the inside of said interior side 138, said spring 102 by compressive means forcing said curved plate 104 against said outer brace 34, said outer brace 34 thereby forced against and restrained from lateral motion by pressure contact with the interior of said housing clamp 106, a solenoid 96 affixed to the exterior of said clamp housing 106 around said shaft 105, whereby said shaft 105 is displaced outward from said clamp housing 106 when said solenoid 96 is activated thereby compressing said spring 102 and releasing the pressure on said curved plate 104 and on said outer brace 34, said solenoid 96 fitting within said slot 74 and free to move therein parallel to the axis of said bottom outer strut 34 as shown in FIGS. 14A-14C, said axial pivot 100 further comprised of two washers 80, each surrounding said outer brace 34 and resting on either side of the outside of said clamp housing 106, two springs 72, one each positioned concentrically around said outer brace 34 on either side of said clamp housing 106 outward of each of said washers 60, the inner end of said inboard spring 72 resting against the inside of said inner end 142 and the outer end of said outboard spring 72 resting against the inside of said outer end 143 as shown in FIG. 14A, said two springs 72 by compression or extension permitting movement of said outer brace 34 through said spherical bearing 145 by plus or minus 4.5 inches, electrical leads 134 from said solenoid 96 conveyed from and through said clamp housing 106 through said slot 74 as shown in FIGS. 14A-14C, motion arrow 110 in FIG. 13A showing the direction of motion of one of said outer bottom struts 25 relative to said outer brace 34, motion arrows 110 in FIG. 14A showing relative motion of said clamp housing 106 with regard to said spring housing 103 and to said outer brace 34.

Figure 11A:
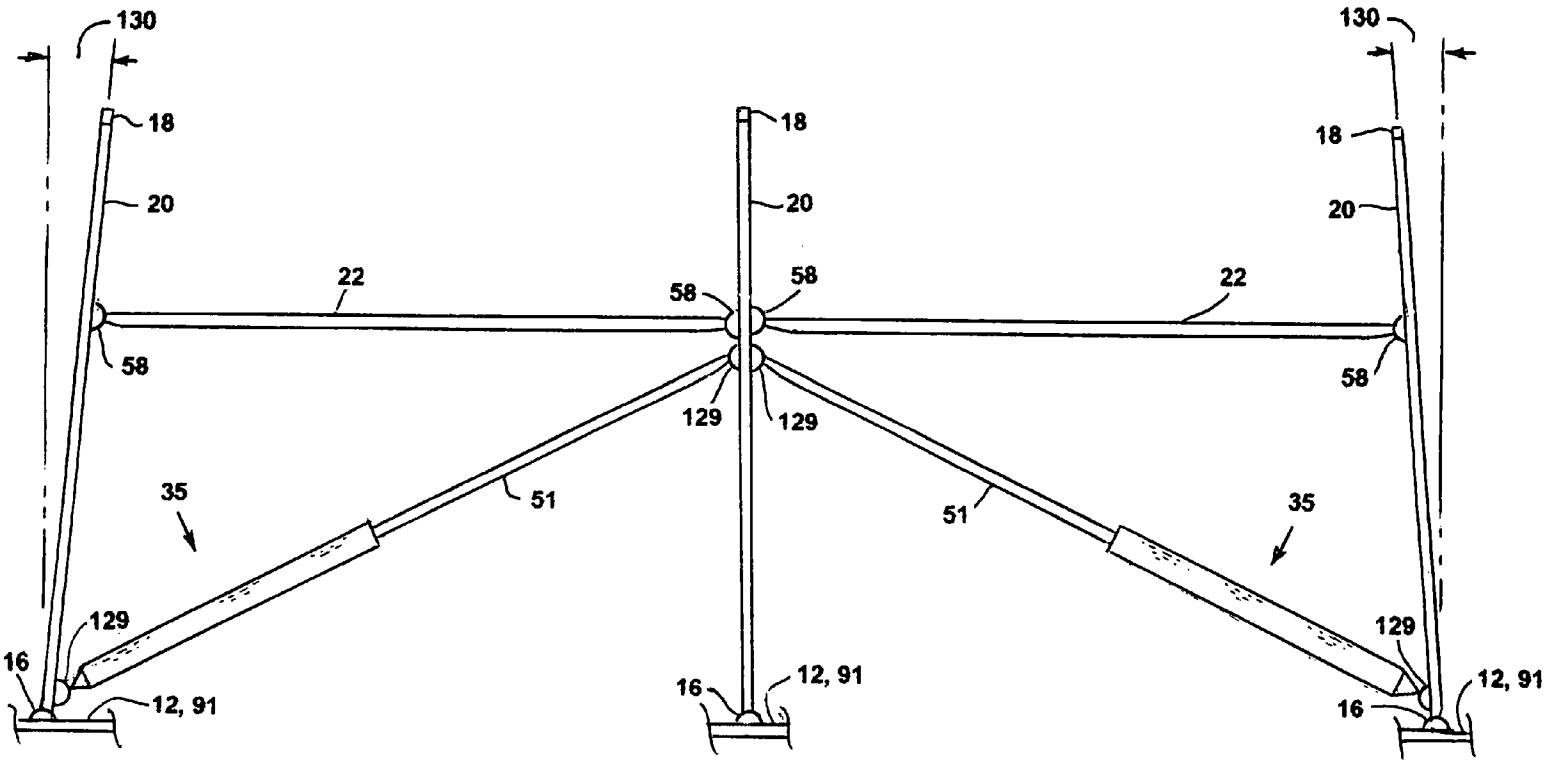
FIG. 11A shows a side view of three supporting legs
Figure 11B:
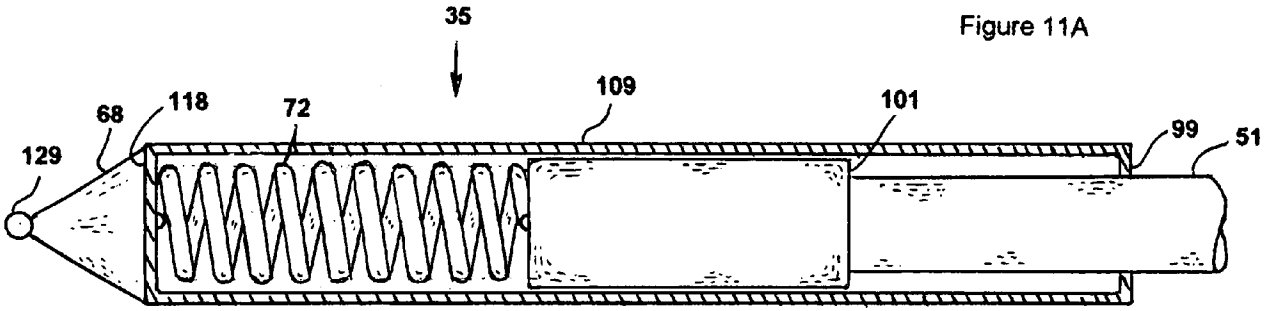
FIG. 11B shows a sectional side view of a limit strut assembly

Four long straight horizontal rigid members each 24 feet long, termed side struts 22, two on each side of said control pod 4, each respectively pivotally affixed at each end by a side strut pivot 58 affixed on the sides of and seven feet below the top of each of said vertical 11 struts 20, said middle vertical strut 20 supporting said pivotal affixing means on both sides, said two side struts 35 on each side being aligned horizontally and being parallel to said long pontoons 30, 31 and to the long axis of said control pod 4 as shown in FIGS. 1, 2, 11A.

Four long straight rigid members, termed limit struts 51, two on each side of said control pod 4, each of said two struts 51 respectively pivotally affixed at each end by said pivotal affixing means 129 on either side of said middle vertical strut 20 each 7.5 feet below the top of said middle vertical strut 20, said two struts 51 extending outward and downward away from said middle strut 20, a limit strut assembly indicated by the general reference number 35, said assembly 35 comprised of a long rigid round cylinder 109, the ends of said cylinder 109 terminating perpendicular to the axis of said cylinder 109, said cylinder 109 constricted at one end by an attached rigid annular ring 99, said annular ring 99 centrally affixed to the interior of the upper end of said cylinder 109, a rigid circular plate 118 affixed to periphery of the lower end of said cylinder 109, a cone 68, said cone 68 affixed peripherally affixed to the exterior periphery of said plate 118 and extending diagonally downward and pivotally affixed to said pivot 129 at the bottom of and on the inside of the proximate outer vertical strut 20 as shown in FIG. 11A, a spring 72 centrally affixed to the inside of said plate 118 and extending concentrically inward and upward within said cylinder 109 and at its distal end affixed within said cylinder 109 to the lower end of a cylindrical guide 101, said cylindrical guide 101 comprised of a cylinder, said cylindrical guide 101 inside of, concentric with and congruent to the interior of said cylinder 109, the lower end of said limit strut 51 centrally and axially affixed to the upper end of said cylindrical guide 101 inside said cylinder 109 a distance of three feet from said constriction 99 within said cylinder 109, when said craft 1 is level, whereby when said craft 1 is level, the compressive force of said spring 72 between said plate 118 and said limit strut 51 then being 200 pounds and when the center of said craft 1 is elevated relative to said end pontoon segments 32, said spring 72 is extended by 3.8 feet, said guide 101 contacting and restrained by the inside of said constriction 99, the tension in said spring 72 then having linearly increased with said displacement to a force of 800 pounds, and further, when the center of said craft 1 is depressed relative to said end pontoon segments 32, said spring 72 is completely compressed by 3.0 feet, by a force of 300 pounds as shown in FIGS. 1, 2, 3, 11B, eight attachment means 128, one each for affixing a knee pulley 10, four on each side, each of said attachment means 128, adjacent and slightly below each of said pivots 66 on said vertical struts 20, two adjacent attachment means 128 on said center vertical strut 20 and one each on each outer vertical strut 20 as shown schematically in FIG. 15.

Figure 12A:
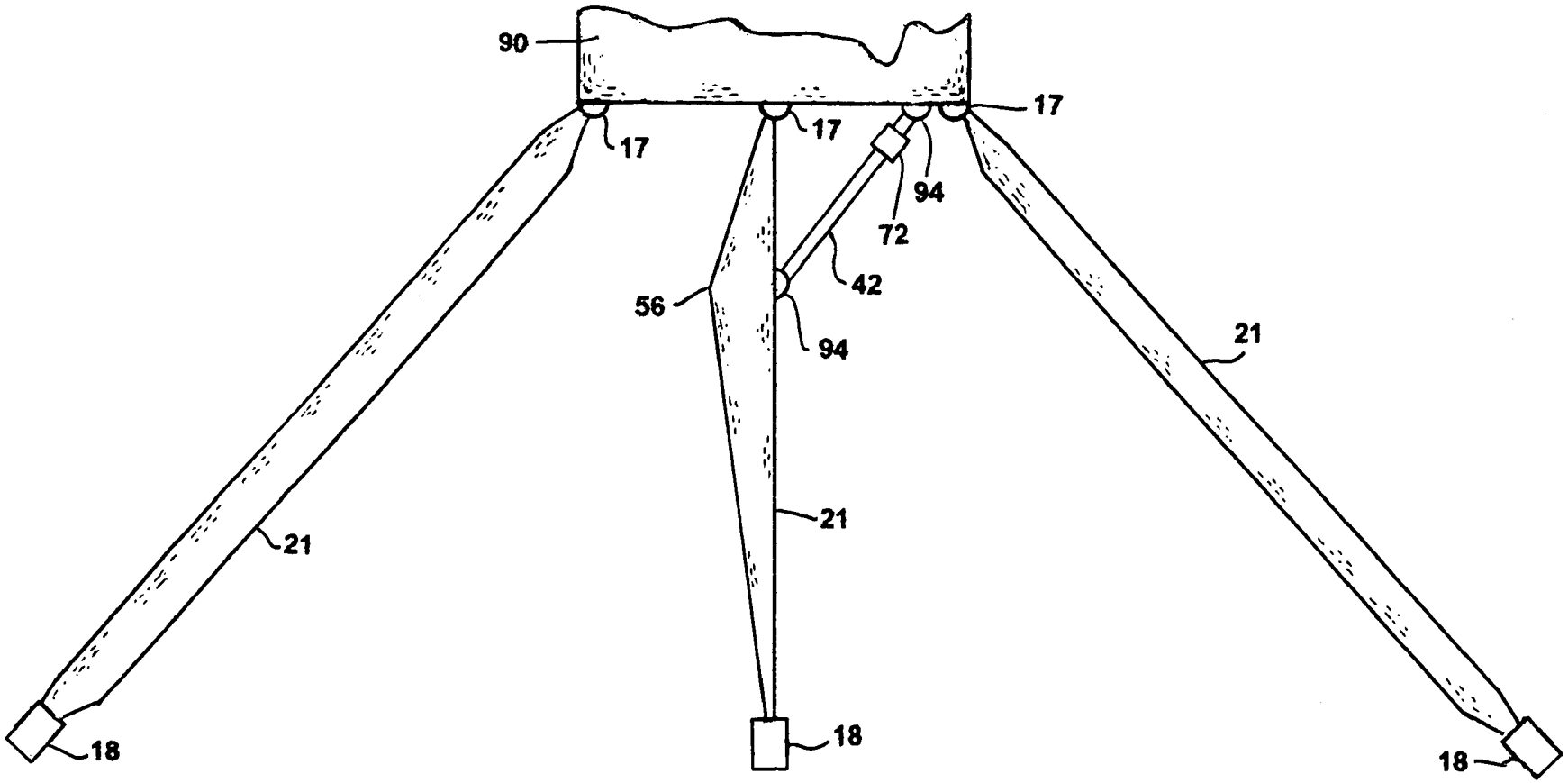
FIGS. 12A-12C show schematic top views of top struts, power struts and bottom struts
Figure 12B:
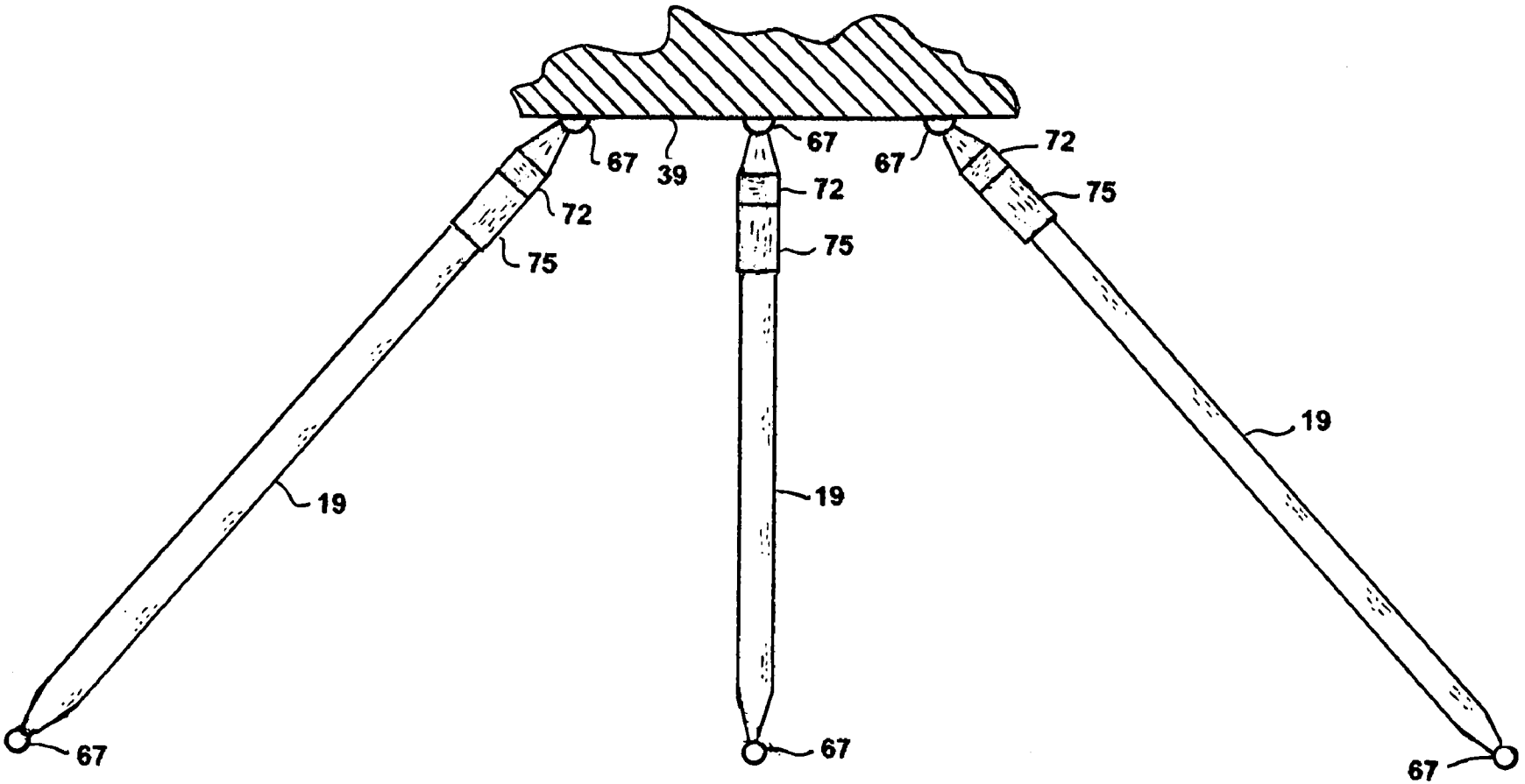
Figure 12C:
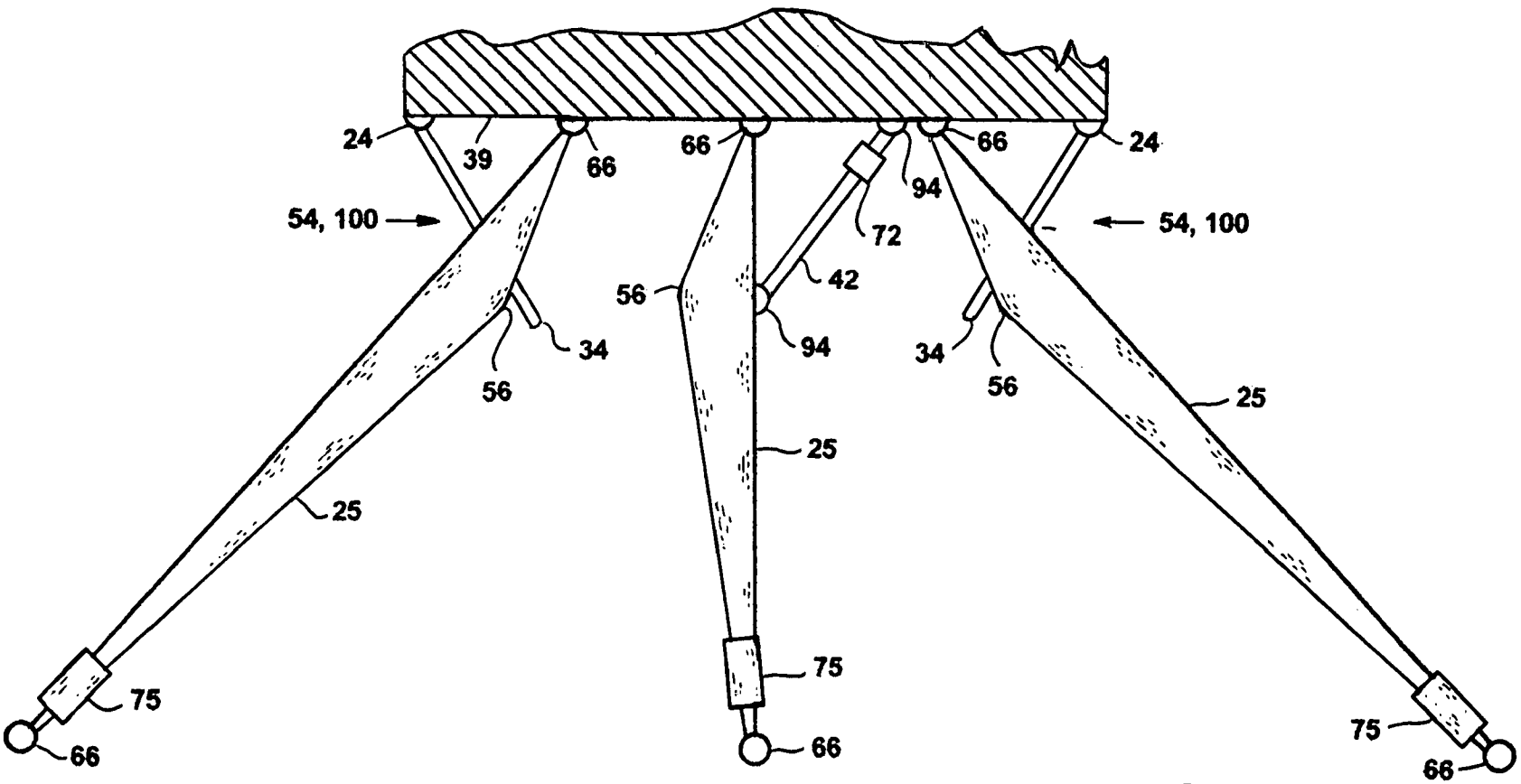

Said struts 19, 21, 22, 25, 51 preferably being made of titanium. Said vertical struts 20 and said bottom struts 25 are supported by said braces 42, 34 and are thicker 56 at these points of support as shown in FIGS. 12A, 12C.

Winches, Cables and Slings

Figure 17:
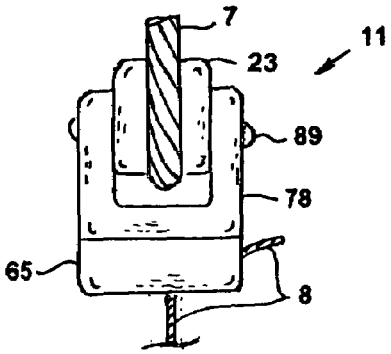
FIG. 17 shows a side view of a pulley assembly
Figure 18A:
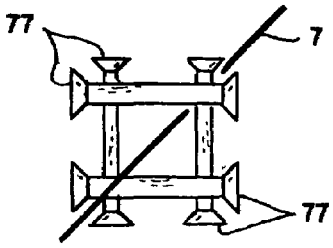
FIGS. 18A and 18B show schematic perspective and side views of a cable roller guide and a support cable
Figure 18B:
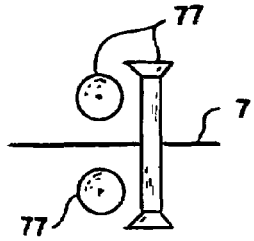
Figure 16:
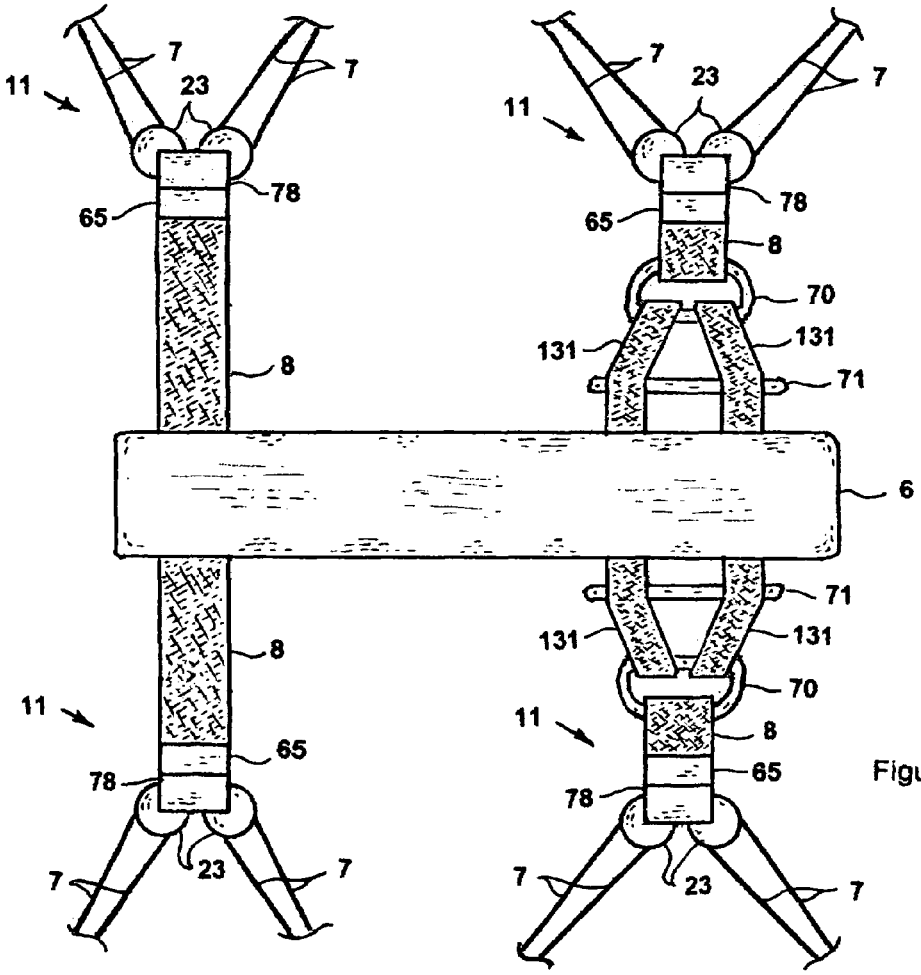
FIG. 16 shows a schematic top view of cables and slings supporting a load

Eight attachment points 128, one each of said four outer vertical struts 20, inboard and seven feet below each knee hinge 18 and two each on each of said inner vertical struts 20 inboard and adjacent to each other seven feet below each knee hinge 18, eight knee pulleys 10, one each respectively secured to one of said attachment points 128, each of said knee pulleys comprised of an 18 inch diameter double sheaved pulleys, four pulley assemblies each indicated by the general reference number 11 and each comprised of a flat rectangular plate, a pulley base 78, said pulley base 78 bent about the center of its long axis forming a U-shaped piece, the ends of said U-shaped piece 78 being parallel and separated by slightly more than the thickness of a single pulley sheave 79, the bottom of said U-shaped piece being oriented horizontally as shown in FIG. 17, two of said sheaves 79, 18 inches in diameter, lying in the same plane, parallel, horizontally adjacent to each other and rotatably secured to and within said pulley base 78 between said two parallel ends of said U-shaped piece 78 by one of two shafts, each termed a pulley axle 80, one each axially centered in and rotatably securing one of said two sheaves 79, two long flexible flat strong strips, each termed a single sling 8, said rearward sling further comprised of two short slings, each termed a rear single sling 8, four securing and releasing attachment means, termed a sling adjuster and release 65, each of said releases 65 securing, adjusting or releasing an end of one of said four single slings 8, the top of each of said releases 65 respectively affixed to the bottom of one of said four pulley bases 78 as shown schematically in FIG. 15, 16, 17, two parallel, adjacent central rear slings 131 spaced apart and held apart outboard, on each side, toward their ends by one of two rigid members, each termed a spacer 71, each of said spacers 71 attached centrally parallel to the length of said craft 1 inboard to the outboard ends of said two central slings 8, on each side, by attaching means (not shown), the two outboard ends of each of said central slings 131, on each side, secured to one of two rings, each termed a sling ring 70, each of said sling rings 70 further secured further outboard, one on each side, to one of said single rear slings 8, said four load cables 7, the eight free ends respectively and adjustably secured by one of said eight winches 9, four on each side, each of said eight cables 7 deploying respectively outward through one of said openings 76 through one sheave of two sheaves of one of said knee pulleys 10, through one sheave of said pulley assembly 11 back through the other sheave of said double sheaved knee pulley 10, through and resting on one of said cable rests 115 and extending inward to and secured by one of said securing means 59, each sheave of each of said four pulley assemblies 11 supported by a doubled cable 7, each doubled cable 7 respectively supported by an outer knee pulley 10 and by a middle knee pulley 10, said single forward sling 8 and said two central slings 131 supporting a load 6, as shown in FIGS. 4, 16.

Controls

Controls (not shown) preferably within said control pod and accessible by at least one person seated, in said seating means 147 (not shown), at either end of said control pod 4 to vary the speed and direction of thrust of said propulsion means 60, controls (not shown) within or external to said control pod 4 to vary the height and span of said supporting legs 5 by activating said solenoids 96 and varying the length of said power struts 19 and/or said bottom struts 25, controls (not shown) to vary the length of said load cables 7 with said winches 9, controls (not shown) to operate said hoist 48, manual and electrical controls as shown schematically in FIG. 5A to raise or lower said bottom platform 28 by extending or retracting said retractable support cables 29, controls (not shown) to release, extend or shorten the ends of a sling 8 from at least one of said pulley assemblies 11 with said sling release 65 shown schematically in FIGS. 10A-10C and controls (not shown) to control lighting means within and external to said control pod 4.

Pumping means 139 (not shown), bilge pumps and hoses, for pumping out a flooded slung vessel 6 are contained in each of said four inner end pontoon segments 32.

Operation of the Vessel

Said craft 1, the Sea Dog, functions in the following manner. When under way with no load, said control pod 4 is normally positioned a few feet above the water 3 and said long pontoons 30, 31 on either side are pulled inward by lengthening said power struts 19. With an 8 foot wide span between the inner long pontoons 31, the beam of the craft 1 is 30 feet. With the bottom platform 28 raised and the control pod 4 one foot above the water 3, the top rack 40 of the control pod 4 is 15 feet above the water 3. The six supporting legs 5 which form the framework, three on each side, then are compactly folded inward with the knee hinges 18 of the legs 5 being about 24 feet above the water 3 and outboard of the outer long pontoons 30 by about 6 feet. The control pod 4 is then less than 2 feet from each inner long pontoon 31.

All of said pontoon segments 32, 57, 107, 112, 117 pitch independently of each other. The inner middle three pontoon segments 107, 117 on each side pitch independently but roll together making the over all configuration of the craft 1 more stable as the opposing outer bottom edges of an adjacent pair 107, 117 are deeper in the water when traversing the crest of a wave. The other pontoon segments 32, 57, 112, 117 roll and pitch independently. Each of said six supporting legs 5 is respectively pivotally supported by a table top pivot 16 on the top 91 of one of four three-cornered end tables 12 or on the top 91 of one of two three-cornered center tables 140. Each of said three table legs 13 of each of said four end tables 12 is respectively supported at one of said pivots 15 below the center of buoyancy of a pontoon segment 32, 117. The two inboard table legs 13 of each of said center tables are spaced apart and are respectively supported by two hinged means 119 in one of said two inner middle pontoon segments 107 with the outboard third leg 13 supported by pivoting means in the adjacent outer middle pontoon segment 112. Said pivot bags 73 and slot sleeves 113 respectively exclude water and objects from entering said conical depressions 14 and said hinge slots 111. The result is that fourteen of said table legs 13 move freely within their respective conical depressions 14 and said two pairs of table legs 13 in each of said inner middle pontoon segment 107 freely rotate laterally freely their respective slot hinges 111.

Because of their hinged and pivoted connections to each other, the twenty articulatable pontoon segments 32, 57, 107, 112, 117 are particularly stable and freely match the changing orientation of the waves. When an end pontoon segment 32 is more than half way over a wave crest, its flat bottom 83 becomes flush with the topography of the new wave surface. It is commonly the case that one of the three outer supporting pontoon segments 32, 117 supporting an outer leg 5 has a different orientation than the other two. Likewise, the orientation of each of said two inner middle pontoon segments 107 will vary from their respective proximate outer middle pontoon segments 112 when traversing a wave crest.

The craft 1 is not rigidly framed. The six knee hinges 18, one each at the top of each of the six vertical struts 20, are respectively connected to the outer ends of said top struts 21. Said pivoting connections 16, 17, 66, 67, 68 for said struts 19, 21, 22, 25 and said pivoting connections 68, 94, 100 for said braces 34, 42 are all freely rotatable pivoting connections. The configuration of all of the six supporting legs 5 is varied at the same time in the same way with the result that they all always have the same shape. Said six top struts 21, said six vertical struts 20 and said four side struts 22 are of fixed length. Except when being adjusted, said six power struts 19, and said six bottom struts 25 and said four outer braces 34 are of fixed length. When not being adjusted, these struts 19, 25, said outer braces 34 and said middle braces 42 all vary in length due to their spring loading 72 by at least plus or minus 4.5 inches. The spring loading on said six power struts 19 however varies the length of each of said power struts 19 by at least plus or minus two feet to insuring that the loading by a leg 5 on each of said tables 12 is fairly constant.

As a result of said articulating pontoon segments 32, 57, 107, 112, 117, said spring loaded legs 5, said spring loaded braces 34, 42, said pivoting bottoms 16 of said legs 5, said tables 12, 140, said pivoting or rotation bottoms of said table legs 15, 119 and the stabilizing effect of said side struts 51 and of said side strut assemblies 35, the craft 1 does not abruptly pitch when crossing a large wave crest as occurs with most rigid hulled vessels.

Adjustment of the lengths of said bottom struts 25 require that said solenoids 96 within each of them first be energized thereby reducing the pressure of said curved plates 102 respectively against each of said four outer bottom braces 34. They then move freely within their respective axial bearing pivots 68. When the lengths of the struts 19, 25 have been adjusted, said four solenoids 96 are deenergized and said curved plates 104, by the pressure of said solenoid spring 102 between said curved plate 104 and said solenoid housing 106, affix a new, but variable, position for said solenoid housings 106 on their respective outer braces 34.

The height of each knee hinge 18 at the top of each vertical strut 2G relative to the control pod 4 is varied by changing the length of the power struts 19. For normal operations, the lengths of the bottom struts 25 are not changed and these are normally equal in length to the top struts 21 with a length of 19 feet for each of the two middle bottom struts 25 and 25.8 feet for each of the four outer bottom struts 25.

Generally all of the components of the craft 1 move in response to the wave action beneath it. These motions however are constrained when certain limits are reached. Said limit struts 51 are each preloaded to an extension force of 200 pounds when level and can vary by plus 3.0 feet or minus 3.8 feet. When the craft 1 is crossing a wave crest and said four limit strut assemblies 35 become fully extended and the tension restoring force in each assembly 35 then has increased linearly to 800 pounds. The limit struts 51 then limit additional downward flexing of the ends of the craft 1. Said four end pontoon segments 32 then become slightly elevated, pressing the center of the craft 1 into the wave crest. When the craft 1 is in the trough of a wave and the limit strut assemblies 35 are fully compressed, the compressive restoring force in each assembly has then increased linearly to 300 pounds. The limit struts 51 then limit additional upward flexing of the ends of the craft 1. Said four end pontoon segments 32 are then pressed into the sides of the wave trough tending to lift the center of the craft 1. Also, the downward flex angle 127, 20 degrees, sets the maximum amount of downward flexing between pontoon segments 32, 57, 107, 112, 117 relative to each other as shown in FIGS. 7B, 8D.

On average when a load is slung, each of the two middle legs 5 supports twice the loading of an outer leg 5 as each supports two knee pulleys 10, one on each side, while each of said outer legs 5 supports only one knee pulley 10. Therefore, to provide extra central displacement for the craft 1, sections of the inner pontoon segments 57, 107, 112, 117 on each side are extended upward by 2 feet to 6.5 feet.

Said four side struts 22 are each affixed between an outer vertical strut 20 and a middle vertical strut 20 seven feet below their respective knee hinges 18 and counteract the forces created by said knee pulleys 10 by the loading of the load cables 7 when a load 6 has been slung.

When supporting a large vessel 6, the process of slinging it is to place the slings 8 under the vessel 6 straddling the middle of the vessel 6 and to offset these to one side if the vessel 6 is listing so that, when lifted, the vessel 6 is vertical. The span of the craft 1 is then narrowed to place the supporting cables 7 in as vertical an orientation as possible. Also the slings 8 are shorted to give the longest length possible to said support cables 7. Then the vessel 6 is lifted only as far as is required to secure it against moving relative to the craft 1. The slings 8 can be adjusted relative to each other and relative to the length of the craft 1. The rear sling 8 is split into two central slings 131 to permit the slinging of a shorter or smaller load 6 with two pulley assemblies 11, one on each side. The slings 8 and support cables 7 can safely support about 50 tons however in severe weather, support of smaller loads 6 may be advisable. The skill and experience of the crew as well as the wind conditions are also factors to consider when attempting to sling a load 6.

When the power struts 19 are adjusted to make the top struts 21 roughly level and the bottom struts 25 are extended, the configuration of the craft 1 is low and wide. However beyond a free span of about 42 feet, the load 6 which can be safely supported diminishes as the span increases since the vertical struts 20 are then increasing less vertical. A no-load free span of about 60 feet, a beam of 82 foot, is possible.

Said retractable platform 97 provides versatility in the transport of a load 6 or people. Said plates 36, 37 forming the ends can be lowered to form a level extension or a downward ramp as shown in FIG. 5F. This permits the bottom compartment 28 to be loaded and unloaded with a forklift to or from a dock to which the height of the craft 1 has been adjusted for variations in the tide. For an open span (the width of the dock and the inner clearance of the craft 1) of less than 35 feet, the working height is at least 22 feet and in this configuration the bottom platform 28 supports 25 tons. Alternately these plates 36, 37 can be folded back onto the lowered bottom platform 28 as shown in FIG. 5E to allow easier access to a slung vessel 6. Until it is needed, this structure 97 is raised upward and compactly stored out of the way under the control pod 4 as shown in FIG. 5D.

Thus a new, versatile rescue and transport craft has been shown. Those skilled in the art will readily observe that numerous other modifications and alterations may be made without departing from the spirit and scope of the invention. These include; (1) six articulating pontoon segments, three on each side, with six legs 5, one each pivoted below the center of buoyancy of a pontoon segment, can be used to support each of the six legs 5, (2) the pivots 49 and hinges 26 used to articulatably attach adjacent pontoon segments can be modified to accommodate fuel, utility, control and communication lines and can be made using sealed ball bearings and/or roller bearings, (3) means to lock the articulating connections 26, 49 between pontoon segments 32, 57, 107, 112, 117 can be made to prevent pitching and/or rolling motion between them to provide the crew with options for dealing with unusual weather and loading conditions can be made, (4) said bilge pumps and hoses 139 can be used for fighting fires, (5) the structure above the control pod 79, 90 can be made detachable to make shipping and handling of a disassembled craft 1 easier, (6) additional securing means for lashing a slung vessel 6 to the craft 1 to avoid having it roll independently of the craft 1 before and after it is slung can be utilized, (7) other equipment can be added to said control pod 4 including a galley, navigation, communication and rescue equipment and a toilet, and (8) each of said four outward facing seats 147, two inside at each end of the control pod 4, can be made to each be convertible into a narrow bunk, (9) the individual pontoon segments can be made as flexing units, (10) the struts can be made aerodynamically smooth, (11) a short sturdy railing around the outer top edge of the top rack, a robust impact grillwork for each end of the control pod and climb-walk means for the vertical and top struts can be made, and (12) a craft can be made with articulating pontoon segments or with an articulating framework, but not both (13) four legs can be used rather than six utilizing a single sling, (14) an air compressor and a water distillation unit can be added and (15) means to transfer fuel from one end of the craft to the other to balance the overall loading can be devised. Accordingly, the above disclosure is not intended as limiting and the appended claims are to be interpreted as encompassing the entire scope of the invention.

| Numeral | Description |
|---|---|
| 1. | General reference number for a craft according to the present invention |
| 2. | Centered hole |
| 3. | Water |
| 4. | General reference number for the control pod |
| 5. | General reference number for support leg |
| 6. | Load |
| 7. | Cable, load |
| 8. | Sling |
| 9. | Winch |
| 10. | Knee pulley, double sheaves |
| 11. | General reference number for pulley assembly |
| 12. | Triangular end table |
| 13. | Table leg |
| 14. | Conical depression |
| 15. | Pivot, table leg |
| 16. | Pivot, table top |
| 17. | Top pivot |
| 18. | Knee hinge |
| 19. | Power strut |
| 20. | Vertical strut |
| 21. | Top strut |
| 22. | Side strut |
| 23. | Pulley |
| 24. | Corner pivot |
| 25. | Bottom strut |
| 26. | Pontoon segment horizontal hinge |
| 27. | Pontoon sleeve |
| 28. | Retractable bottom platform |
| 29. | Platform cable |
| 30. | General reference number for long outer pontoon |
| 31. | General reference number for long inner pontoon |
| 32. | End pontoon segment |
| 33. | Hinge, retractable bottom plate |
| 34. | Outer brace |
| 35. | General reference number for limit strut assembly |
| 36. | Upper end plate |
| 37. | Lower end plate |
| 38. | Bottom plate, control pod |
| 39. | Side plate, control pod |
| 40. | Top plate, control pod |
| 41. | General reference number for clear enclosing surface |
| 42. | Middle brace |
| 43. | Tubular extension, pivot bag |
| 44. | Conical layer, pivot bag |
| 45. | Bellows, pivot bag |
| 46. | Pivot bag extension |
| 47. | Hatch or door |
| 48. | Hoist |
| 49. | Bearing plate |
| 50. | Cylindrical extension |
| 51. | Limit strut |
| 52. | Circular opening |
| 53. | Securing pin |
| 54. | General reference number for solenoid clamp assembly |
| 55. | Transverse hole |
| 56. | Thick central portion, strut |
| 57. | Spacer pontoon segment |
| 58. | Pivot, side strut |
| 59. | Cable securement |
| 60. | Propulsion means |
| 61. | End plate, control pod |
| 62. | Front piece, enclosing surface |
| 63. | Webbing |
| 64. | Side piece, enclosing surface |
| 65. | Sling adjuster and release |
| 66. | Bottom pivot |
| 67. | Power strut pivot |
| 68. | Cone |
| 69. | Pivot mount extension, control pod |
| 70. | Sling ring |
| 71. | Sling spacer |
| 72. | Spring |
| 73. | General reference number for pivot bag |
| 74. | Slot |
| 75. | Hydraulic actuator |
| 76. | Opening, side plate |

-continued

| Numeral | Description |
|---|---|
| 77. | Cable roller guide |
| 78. | Pulley base |
| 79. | Top cylinder |
| 80. | Washer |
| 81. | Teflon coating |
| 82. | Hand/foot holds |
| 83. | Bottom surface, pontoon segment |
| 84. | Side surface, pontoon segment |
| 85. | Top surface, pontoon segment |
| 86. | End surface, pontoon segment |
| 87. | Prow |
| 88. | End impact guard |
| 89. | Pulley axle |
| 90. | Top rack |
| 91. | Table top |
| 92. | Cable retraction means |
| 93. | Bottom strut opening |
| 94. | Middle brace pivot |
| 95. | Slot, slot sleeve |
| 96. | Solenoid |
| 97. | General reference number for bottom compartment |
| 98. | Hole, bottom plate |
| 99. | Annular constriction |
| 100. | General reference number for axial pivot |
| 101. | Cylindrical guide |
| 102. | Solenoid spring |
| 103. | Housing, spring |
| 104. | Curved plate |
| 105. | Solenoid shaft |
| 106. | Housing, clamp |
| 107. | Inner middle pontoon segment |
| 108. | Hole, platform |
| 109. | Cylinder, limit strut assembly |
| 110. | Motion arrow |
| 111. | Hinge slot |
| 112. | Outer middle pontoon segment |
| 113. | General reference number for slot sleeve |
| 114. | Facing plate, pontoon segment |
| 115. | Cable rest |
| 116. | Motor-generator unit |
| 117. | Adjacent pontoon segment |
| 118. | Round plate, limit strut assembly |
| 119. | Slot hinge |
| 120. | Manual cable securing means |
| 121. | Manual plate securing means |
| 122. | Swage |
| 123. | Rigid loop |
| 124. | Long ramp cable |
| 125. | Short ramp cable |
| 126. | Support cable, non-retracting |
| 127. | Flex angle |
| 128. | Attachment, knee pulley |
| 129. | Pivot, limit strut |
| 130. | Toe-in angle |
| 131. | Central sling |
| 132. | Walk-on plate |
| 133. | Rope ladder |
| 134. | Solenoid electrical connections |
| 135. | Flat side, clamp housing |
| 136. | Hole, clamp housing |
| 137. | Curved side, clamp housing |
| 138. | Interior side, clamp housing |
| 139. | Bilge pumps and hoses |
| 140. | Triangular center table |
| 141. | Side, slot sleeve |
| 142. | Inner end, spring housing |
| 143. | Outer end, spring housing |
| 144. | Spherical pivot base |
| 145. | Spherical bearing |
| 146. | Hole, spherical bearing |
| 147. | Seat, control pod |

What is claimed is:

1. A marine vessel comprised of a central elevatable elongated enclosure, at least four elongated pontoons symmetrically disposed, at least two on each side of and parallel to said enclosure and aligned end-to-end with each other in at least one row, all of said at least two pontoons in a row flexibly affixed to each other at their adjacent ends by a first affixing means, at least four supporting articulating members symmetrically and respectively affixed by a second affixing means, at least two on each side, to said enclosure, the lower end of each of said members freely and respectively affixed, by a direct third affixing means or by indirect affixing means, at or below the center of buoyancy of one of said pontoons, the orientation of and effective length of each of said supporting members being adjustable by adjusting means, said vessel having controllable propulsion means and access means into said enclosure for personnel, said enclosure and/or said at least four members supporting a load with load supporting means, whereby each pontoon is self stabilizing when on rough water due to the low, central attachment point of the load which it supports and each pair of joined pontoons, freely and unrestrictedly (1) pitches or (2) pitches and rolls relative to the other pontoon, and whereby a load is supportable within or under said enclosure and is transportable over water.

2. A marine vessel as in claim 1 whereby said second affixing means is comprised of pivotable and/or hinged affixing means.

3. A marine vessel as in claim 2 wherein said vessel is further comprised of four parallel aligned rows of elongated pontoons, two symmetric centered adjacent rows on each side of said enclosure, said two inboard rows comprised of at least two pontoons and said two outboard rows each comprised of at least one pontoon, each pair of pontoons in a row flexibly affixed together at their common ends by said first flexible affixing means, said first affixing means comprised of horizontally hinged and/or axially rotable attachment means.

4. A marine vessel as in claim 3 wherein said supporting members are comprised of three pairs of supporting members, six total, and each of said four rows is comprised of five pontoons, twenty total.

5. A marine vessel as in claim 4 wherein said indirect affixing means is further comprised of centrally, freely, pivotally and respectively affixing the lower end of each of said six supports to the top of one of six rigid, level triangular table tops, two central table tops adjacent to said enclosure on either side, and four end table tops, each respectively disposed distally, on each side, to each central table top toward the two ends of said two rows of pontoons on each side, three rigid legs, each leg respectively affixed to and extending perpendicularly downward from one of the three corners of each of said six table tops, the lower end of each of said legs freely and centrally affixed (1) at or below the center of buoyancy of a pontoon, or (2) adjacent to, and along the length of its associated two rows, the vertical axis of the center of buoyancy of a pontoon by said third affixing means, said third affixing means further comprised of freely pivotable or hinged means, and said two outboard end pontoons and said outboard center pontoon, three of five outboard pontoons on each side, six total, each respectively supporting the outboard leg of one of said six table tops, the two inboard end pontoons on each side at each end of said two inboard rows, eight total, each respectively supporting one leg of the two remaining inboard legs of each of said table tops supported by an outboard end pontoon, each of two inboard legs of each of said two central table tops, four total, both legs respectively supported by one of said inboard center pontoon being freely supported by hinged means centered and equally spaced lengthwise from and (1) below or (2) at the center of buoyancy of their respective inboard center pontoons, four outboard pontoons not supporting a member and respectively spacing said end outboard pontoons from said outboard center pontoon, whereby each of said twenty pontoons is self stabilizing when on rough water due to the low, unrestricted central attachment point of the respective load which it supports.

6. A marine vessel as in claim 1 wherein each of said articulating members are further respectively comprised of at least two flexibly affixed articulatable and adjustable sections, whereby said adjustable means adjusts the orientation of and effective length of said supporting members thereby altering the height of said enclosure over the water and/or the distance between the pontoons on either side of said enclosure.

7. A vessel as in claim 1 wherein said propulsion means is comprised of a pair of propulsion units, symmetrically disposed, one each respectively on each side in each of said at least one pair of pontoons.

8. A vessel as in claim 1 wherein said load supporting means is winch powered and is comprised of at least one sling.

9. A vessel as in claim 1 wherein said pontoons are flat bottomed.

10. A marine transport system comprised of a vessel having a central elevatable elongated enclosure, at least four elongated pontoons symmetrically disposed, at least two on each side of and parallel to said enclosure and aligned end-to-end with each other in at least one row, all of said at least two pontoons in a row flexibly affixed to each other at their adjacent ends by a first affixing means, at least four supporting articulating members symmetrically and respectively affixed by a second affixing means, at least two on each side, to said enclosure, the lower end of each of said members freely and respectively affixed, by a direct third affixing means or by indirect affixing means, at or below the center of buoyancy of one of said pontoons, the orientation of and effective length of each of said supporting members being adjustable by adjusting means, said vessel having controllable propulsion means and access means into said enclosure for personnel, said enclosure and/or said at least four supporting members supporting a load with load supporting means, whereby each pontoon is self stabilizing when on rough water due to the low, central attachment point of the load which it supports and each pair of joined pontoons, freely and unrestrictedly (1) pitches or (2) pitches and rolls relative to the other, and whereby a load is supportable within or under said enclosure and is transportable over water.

11. A system as in claim 10 whereby said second affixing means is comprised of pivotable and/or hinged affixing means.

12. A system as in claim 11 wherein said vessel is further comprised of four parallel aligned rows of elongated pontoons, two symmetric centered adjacent rows on each side of said enclosure, said two inboard rows comprised of at least two pontoons and said two outboard rows each comprised of at least one pontoon, each pair of pontoons in a row flexibly affixed together at their common ends by said first flexible affixing means, said first affixing means comprised of horizontally hinged and/or axially rotable attachment means.

13. A system as in claim 12 wherein said supporting members are comprised of three pairs of supporting members, six total, and each of said four rows is comprised of five pontoons, twenty total.

14. A system as in claim 13 wherein said indirect affixing means is further comprised of centrally, freely, pivotally and respectively affixing the lower end of each of said six supports to the top of one of six rigid, level triangular table tops, two central table tops adjacent to said enclosure on either side, and four end table tops, each respectively disposed distally, on each side, to each central table top toward the two ends of said two rows of pontoons on each side, three rigid legs, each leg respectively affixed to and extending perpendicularly downward from one of the three corners of each of said six table tops, the lower end of each of said legs freely and centrally affixed (1) at or below the center of buoyancy of a pontoon, or (2) adjacent to, and along the length of its associated two rows, the vertical axis of the center of buoyancy of a pontoon by said third affixing means, said third affixing means further comprised of freely pivotable or hinged means, and said two outboard end pontoons and said outboard center pontoon, three of five outboard pontoons on each side, six total, each respectively supporting the outboard leg of one of said six table tops, the two inboard end pontoons on each side at each end of said two inboard rows, eight total, each respectively supporting one leg of the two remaining inboard legs of each of said table tops supported by an outboard end pontoon, each of two inboard legs of each of said two central table tops, four total, both legs respectively supported by one of said inboard center pontoon being freely supported by hinged means centered and equally spaced lengthwise from and (1) below or (2) at the center of buoyancy of their respective inboard center pontoons, four outboard pontoons not supporting a member and respectively spacing said end outboard pontoons from said outboard center pontoon, whereby each of said twenty pontoons is self stabilizing when on rough water due to the low, unrestricted central attachment point of the respective load which it supports.

15. A system as in claim 10 wherein each of said articulating members are further respectively comprised of at least two flexibly affixed articulatable and adjustable sections, whereby said adjustable means adjusts the orientation of and effective length of said supporting members thereby altering the height of said enclosure over the water and/or the distance between the pontoons on either side of said enclosure.

16. A system as in claim 10 wherein said propulsion means is comprised of a pair of propulsion units, symmetrically disposed, one each respectively on each side in each of said at least one pair of pontoons.

17. A system as in claim 10 wherein said load supporting means is winch powered and is comprised of at least one sling.

18. A system as in claim 10 wherein said pontoons are flat bottomed.

19. A method for transporting goods and personnel over water comprised of the following steps:

providing at least two pairs of elongated parallel and spaced apart pontoons, each at least two pairs of pontoons connected in line end-to-end in at least two rows, providing at least two pairs of supporting members, each supporting member freely, respectively and symmetrically affixed at or below the center of buoyancy of one of said at least two pairs of pontoons, adjustably and symmetrically connecting the upper ends of said supporting members to a central elongated enclosure whereby each pontoon is self stabilizing when on rough water due to the low, unrestricted central attachment point of the load which it supports and each pair of joined pontoons, freely and unrestrictedly (1) pitches or (2) pitches and rolls relative to the other, and whereby a load is supportable within or under said enclosure and is transportable over water.

20. A method as in claim 19 whereby said second affixing means is comprised of pivotable and/or hinged affixing means.

21. A method as in claim 20 wherein said vessel is further comprised of four parallel aligned rows of elongated pontoons, two symmetric centered adjacent rows on each side of said enclosure, said two inboard rows comprised of at least two pontoons and said two outboard rows each comprised of at least one pontoon, each pair of pontoons in a row flexibly affixed together at their common ends by said first flexible affixing means, said first affixing means comprised of horizontally hinged and/or axially rotable attachment means and wherein said pontoons are flat bottomed.

22. A method as in claim 21 wherein said supporting members are comprised of three pairs of supporting members, six total, and each of said four rows is comprised of five pontoons, twenty total, and wherein each of said articulating members are further respectively comprised of at least two flexibly affixed articulatable and adjustable sections, whereby said adjustable means adjusts the orientation of and effective length of said supporting members thereby altering the height of said enclosure over the water and/or the distance between the pontoons on either side of said enclosure.

23. A method as in claim 22 wherein said propulsion means is comprised of a pair of propulsion units, symmetrically disposed, one each respectively on each side in each of said at least one pair of pontoons and wherein said load supporting means is winch powered and is comprised of at least one sling.

* * * * *